US008092317B2

(12) United States Patent
Johnson

(10) Patent No.: US 8,092,317 B2
(45) Date of Patent: Jan. 10, 2012

(54) VISUAL AND TACTILE CONFIRMATION GOLF GRIP AND SYSTEM

(76) Inventor: Lanny L Johnson, Carlsbad, CA (US)

( * ) Notice: Subject to any disclaimer, the term of this patent is extended or adjusted under 35 U.S.C. 154(b) by 0 days.

(21) Appl. No.: 12/980,581

(22) Filed: Dec. 29, 2010

(65) Prior Publication Data

US 2011/0098126 A1 Apr. 28, 2011

Related U.S. Application Data

(60) Continuation of application No. 12/748,621, filed on Mar. 29, 2010, now Pat. No. 8,062,147, which is a continuation-in-part of application No. 12/609,322, filed on Oct. 30, 2009, now Pat. No. 7,794,332, which is a division of application No. 12/236,650, filed on Sep. 24, 2008, now Pat. No. 7,637,821.

(60) Provisional application No. 60/974,705, filed on Sep. 24, 2007.

(51) Int. Cl.
*A63B 53/14* (2006.01)

(52) U.S. Cl. ..... 473/303

(58) Field of Classification Search ..... 473/300–303, 473/251; D21/756, 759
See application file for complete search history.

(56) References Cited

U.S. PATENT DOCUMENTS

| | | | | |
|---|---|---|---|---|
| D172,416 | S | 6/1954 | Brandon | |
| D174,183 | S | 3/1955 | Karns | |
| 3,109,653 | A | 11/1963 | Biggs | |
| 4,466,610 | A | 8/1984 | Israel | |
| 4,537,403 | A | 8/1985 | Farina | |
| 4,795,158 | A | 1/1989 | Kuykendall | |
| D307,169 | S * | 4/1990 | Aldridge | D21/756 |
| 4,919,420 | A | 4/1990 | Sato | |
| 4,932,659 | A | 6/1990 | Freeberg | |
| 5,087,042 | A | 2/1992 | Solheim | |
| 5,133,555 | A | 7/1992 | Bailey | |
| 5,152,533 | A * | 10/1992 | Radakovich | 473/206 |
| 5,158,297 | A | 10/1992 | Johnson | |

(Continued)

FOREIGN PATENT DOCUMENTS

EP 1452208 A1 9/2004

OTHER PUBLICATIONS

International Search Report and Written Opinion of the International Searching Authority for International Application No. PCT/US2011/204453, mailed Apr. 5, 2011, 12 pages.

*Primary Examiner* — Stephen L. Blau

(57) ABSTRACT

A visual and tactile confirmation golf grip and system is provided. The golf grip includes a grip body having an upper portion, a lower portion, a grip length, a proximal end, a distal end, and an exterior body surface. The exterior body surface is defined by a first quadrant, a second quadrant, a third quadrant, and a fourth quadrant. The golf grip may include a first alignment channel, a second alignment channel, a third alignment channel, or a fourth alignment channel. The alignment channels are configured to extend longitudinally along the exterior body surface. The golf grip also includes at least one butt end alignment channel that extends along the proximal end of the golf grip. The alignment channels are sized and dimensioned to accommodate two-point discrimination, and thus allow a golfer to tactilely perceive the alignment channels to help build psychomotor confidence, which ultimately leads to better golf shots.

9 Claims, 27 Drawing Sheets

U.S. PATENT DOCUMENTS

| | | | | |
|---|---|---|---|---|
| 5,217,380 | A | 6/1993 | Martinet | |
| D345,192 | S * | 3/1994 | Solheim | D21/756 |
| D357,295 | S | 4/1995 | Solheim | |
| 5,575,724 | A | 11/1996 | Hannon et al. | |
| 5,590,437 | A | 1/1997 | McMillin | |
| 5,634,859 | A * | 6/1997 | Nesbitt | 473/301 |
| 5,637,043 | A | 6/1997 | Fortis | |
| D391,330 | S | 2/1998 | Solheim et al. | |
| 5,788,582 | A | 8/1998 | Shapiro | |
| 5,788,588 | A | 8/1998 | Hooker | |
| 5,897,440 | A | 4/1999 | Bae et al. | |
| D431,851 | S | 10/2000 | Anderson | |
| D435,074 | S | 12/2000 | Dunham | |
| 6,155,930 | A * | 12/2000 | Madara | 473/226 |
| 6,605,005 | B1 | 8/2003 | Lin | |
| 6,609,981 | B2 | 8/2003 | Hirata | |
| 6,656,054 | B2 | 12/2003 | Ulrich | |
| 6,758,760 | B1 | 7/2004 | Kellogg et al. | |
| 6,840,869 | B2 | 1/2005 | Chen | |
| 6,921,340 | B2 | 7/2005 | Dickie | |
| 7,485,050 | B2 | 2/2009 | Rose | |
| 7,537,525 | B2 | 5/2009 | Wang | |
| 7,637,821 | B2 | 12/2009 | Johnson | |
| 2003/0013539 | A1 * | 1/2003 | Scott et al. | 473/251 |
| 2003/0083142 | A1 * | 5/2003 | Nam | 473/286 |
| 2004/0185955 | A1 * | 9/2004 | Rocconi | 473/241 |
| 2004/0192458 | A1 * | 9/2004 | Daniels | 473/251 |
| 2004/0259655 | A1 * | 12/2004 | Ferris | 473/251 |
| 2005/0026712 | A1 | 2/2005 | Byrd et al. | |
| 2007/0082748 | A1 | 4/2007 | Rose | |
| 2008/0102974 | A1 | 5/2008 | Nam et al. | |
| 2009/0082122 | A1 | 3/2009 | Kellogg | |
| 2009/0170641 | A1 | 7/2009 | Qin et al. | |
| 2009/0253528 | A1 * | 10/2009 | Brolly | 473/251 |
| 2010/0102479 | A1 | 4/2010 | Walls et al. | |

* cited by examiner

VISUAL AND TACTILE CONFIRMATION GOLF GRIP AND SYSTEM

CROSS REFERENCE TO RELATED APPLICATIONS

This application is a continuation of U.S. application Ser. No. 12/748,621, filed Mar. 29, 2010, now U.S. Pat. No. 8,062,147 which is a continuation-in-part of U.S. application Ser. No. 12/609,322, filed Oct. 30, 2009, now U.S. Pat. No. 7,794,332, which is a divisional of U.S. application Ser. No. 12/236,650, filed Sep. 24, 2008, now U.S. Pat. No. 7,637,821, which claims the benefit of U.S. Provisional Application No. 60/974,705, filed Sep. 24, 2007, the entire contents of which are hereby incorporated by reference.

TECHNICAL FIELD

The present disclosure relates to the field of sports equipment, and more particularly, to a visual and tactile confirmation golf grip and system.

BACKGROUND OF THE INVENTION

Perhaps one of the most important fundamental skills in the game of golf is the ability to properly align the golf club face to the intended target. This skill is extremely critical when it comes to the aspect of the game referred to as putting. When putting, a slight misalignment of the golf club face can result in missing a putt by several inches or more. The same holds true for shots made with irons and woods.

Compounding the problem of alignment is the fact that golf grips are not always applied to golf clubs with the proper orientation with respect to the golf club face. Golf grips are often difficult to apply with the correct intended orientation. This difficulty is due, in part, to the viscoelastic nature of the grip material, which makes the grip subject to rotational deformity during and after application. However, much of the inaccuracy in grip alignment stems from the fact that most golf grips are applied by "eyeballing" the orientation of the grip with respect to the golf club face.

When misaligned, the golf grip creates a potential error in shot direction. This is due to the fact that a golfer will often trust that the golf grip was applied with the proper orientation with respect to the golf club face. Trusting that the golf grip was applied properly, especially when the golf grip includes a "reminder," the golfer will grasp the golf grip in accordance with the "reminder" and believe that the golf club face is properly aligned. However, if the golf grip is misaligned, then the golfer will likely be addressing the golf ball with an open or closed golf club face, which results in an error in shot direction.

The orientation of a golf club in space is dependent upon visual and palpation sense. Golf is in part a hand-eye coordination sport, but more than that it is a sport that requires spatial relationships relative to the body's motion in performing the golf swing. One of the inherent body functions is that which is known as proprioception. Proprioception is the ability to sense where any given body part is in relation to other body parts.

There is one other anatomical and physical property in the human body that assists in determining position. This is known as sensibility; the body's ability to determine fine objects by feel. This ability is measured by what is known as two-point discrimination. Two-point discrimination is defined as the ability to discern that two nearby objects touching the skin are truly two distinct points, not one. The test for two-point discrimination is usually performed utilizing two sharp points. Typically, a person has the most sensibility on their finger pads and lips. A normal measurement for two-point discrimination on the finger pads and lips ranges from about 2 to 5 millimeters, while other body parts, such as the back, have a normal two-point discrimination ranging from 30 to 40 millimeters. When the two points are closer together than the range of two-point discrimination a person cannot tell whether they are being contacted by one point or two points.

Motor memory is another important aspect of making a repeatable, consistent golf stroke. A golfer's sense of sight and touch play an important role in the golf swing. In the case of a golf swing, motor memory is very dependent upon tactile sensibility for spatial relationships.

There still remains a need for a golf grip and alignment system to confirm that the golf grip was applied with the desired orientation and that this orientation is maintained throughout the life of the golf grip. Moreover, there is a need for a golf grip that facilitates holding the grip and also helps prevent rotation during use. Specifically, there remains a need for a visual and tactile confirmation golf grip and alignment system that recognizes and utilizes the body's innate abilities of proprioception and sensibility by two-point discrimination.

SUMMARY OF INVENTION

In its most general configuration, the golf grip and system advances the state of the art with a variety of new capabilities and overcomes many of the shortcomings of prior devices in new and novel ways. The golf grip and system overcomes the shortcomings and limitations of the prior art in any of a number of generally effective configurations. The golf grip and system demonstrates such capabilities and overcomes many of the shortcomings of prior methods in new and novel ways.

The present disclosure relates to a visual and tactile confirmation golf grip and system. The golf grip and system are configured such that the golf grip is capable of precise installation in a predetermined orientation with respect to a golf club face.

In one embodiment, the visual and tactile confirmation golf grip includes an alignment channel. The alignment channel may extend longitudinally along the golf grip's anterior or posterior surface. The alignment channel is defined by a channel bottom wall, a channel dextral sidewall, and a channel sinistral sidewall. The alignment channel is sized and dimensioned to accommodate two-point discrimination, and thus allow a golfer to determine by tactile perception the orientation of the golf grip with respect to the golf club face. Additionally, the alignment channel is configured to provide a golfer with visual feedback regarding the alignment of the golf grip with respect to the golf club face.

In another embodiment, the visual and tactile confirmation golf grip includes an alignment projection. The alignment projection may extend longitudinally along the golf grip's anterior or posterior surface. The alignment projection is defined by a projection top wall, a projection dextral sidewall, and a projection sinistral sidewall. The alignment projection is sized and dimensioned to accommodate two-point discrimination, and thus allow a golfer to determine by tactile perception the orientation of the golf grip with respect to the golf club face. For example, the alignment projection may be formed with height and width dimensions similar to those used for Braille (i.e., a height of about 1.5 millimeters and a width of about 0.5 millimeters). Additionally, the alignment projection is configured to provide a golfer with visual feedback regarding the alignment of the golf grip with respect to the golf club face. Moreover, the alignment projection may also perform a "reminder" function so that the golfer will know whether they are grasping the golf grip with the proper hand and finger placement.

In yet another embodiment the golf grip includes a grip body having an upper portion, a lower portion, a grip length, a proximal end, a distal end, and an exterior body surface. The grip body may have a substantially circular cross-section throughout the grip length, or the grip body may have a non-circular cross-section throughout a substantial portion of the grip length. The exterior body surface is defined by a first quadrant, a second quadrant, a third quadrant, and a fourth quadrant. The quadrants are defined by an imaginary first vertical plane that orthogonally intersects an imaginary second vertical plane. In this embodiment, the golf grip may include a first alignment channel, a second alignment channel, a third alignment channel, and a fourth alignment channel. The alignment channels are configured to extend longitudinally along the exterior body surface. Moreover, the golf grip is configured such that for any given quadrant of the golf grip there is only one alignment channel in that particular quadrant.

The alignment channels are sized and dimensioned to accommodate two-point discrimination, and thus allow a golfer to tactilely perceive the alignment channels. Moreover, the size and dimensions of the alignment channels accommodate water run off when the grip is used in rainy weather conditions and also sweat run off. Additionally, the alignment channels facilitate holding the golf grip and club, and provide the grip with an anti-torsion effect that helps keep the grip from rotating in a golfer's hands during use. Further, the alignment channels provide a golfer with the ability to determine by tactile perception, or visually (with or without the aid of an alignment device), whether the grip has been installed without any rotational deformities.

The golf grip may have one or more alignment channels or alignment projections on the exterior surface. Preferably, the alignment channels are strategically positioned such that the golfer is not subjected to conflicting or confusing palpable stimuli. Moreover, the exterior body surface should not contain any additional palpable geometries that, by their position or orientation, would conflict or cause confusion with the golfer's ability to tactilely perceive the alignment channels or the alignment projections.

The system generally includes a golf grip and an alignment device. The alignment device is joined to the golf grip and includes a feedback element. The feedback element projects along a straight line, and thus provides an indication of the alignment of the golf grip with respect to the golf club face. In one particular embodiment, the feedback element is a focused beam of laser light.

BRIEF DESCRIPTION OF THE DRAWINGS

Without limiting the scope of the golf grip and system as claimed below and referring now to the drawings and figures:

Figure 1:
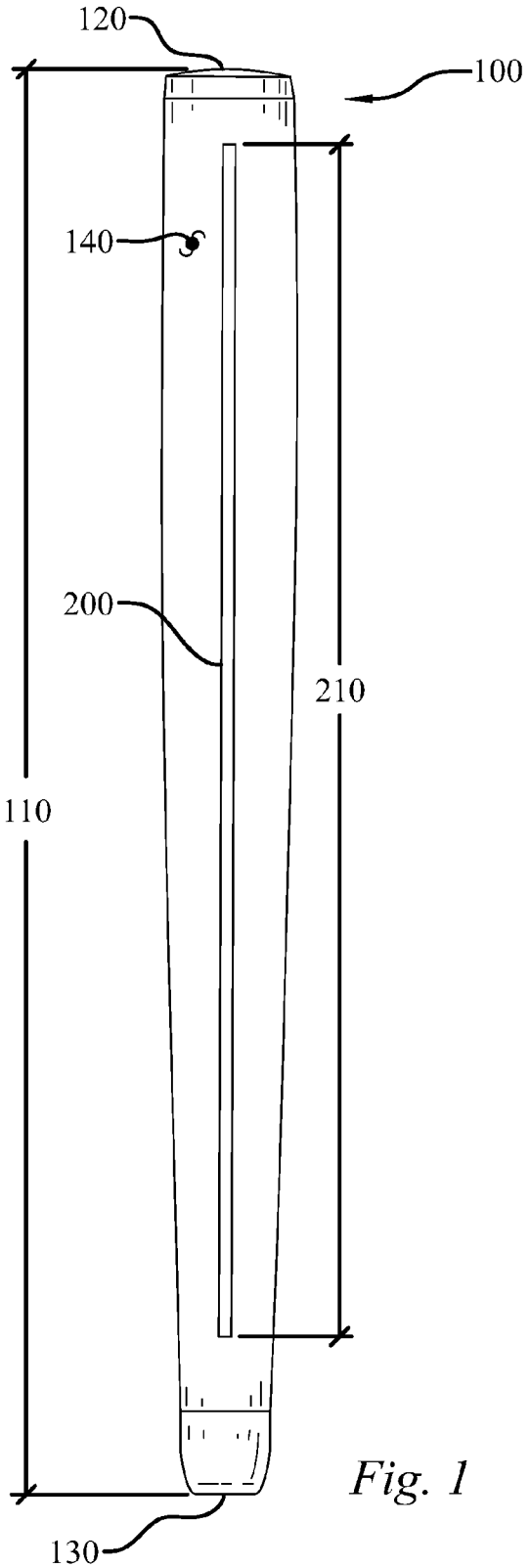
FIG. 1 is a front elevation view of an embodiment of a golf grip, not to scale.

These drawings are provided to assist in the understanding of the exemplary embodiments of the golf grip and system as described in more detail below and should not be construed as unduly limiting the golf grip and system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A visual and tactile confirmation golf grip (100) and system enables a significant advance in the state of the art. The preferred embodiments of the device and system accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the golf grip (100) and system, and is not intended to represent the only form in which the present golf grip (100) and system may be constructed or utilized. The description sets forth the designs, functions, means, and methods of implementing the golf grip (100) and system in connection with the illustrated embodiments. It is to be understood, however, that the same or equivalent functions and features may be accomplished by different embodiments that are also intended to be encompassed within the spirit and scope of the golf grip (100) and system.

With reference generally to FIGS. 1-33, embodiments of a visual and tactile confirmation golf grip (100) and system are shown. The golf grip (100) provides visual and tactile confirmation that the golf grip (100) is aligned in a predetermined orientation with respect to a golf club face (10). The system generally includes the golf grip (100) and an alignment device (400). Before turning to the particular aspects of the system, embodiments of the golf grip (100) will be described in detail.

Figure 2:
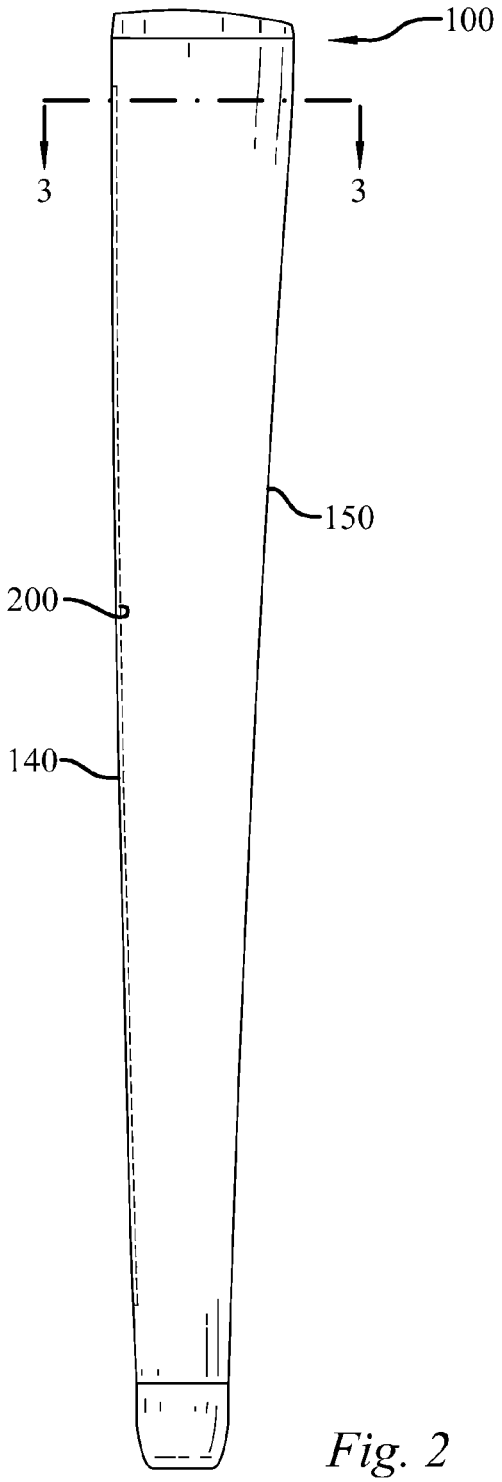
FIG. 2 is a side elevation view of an embodiment of a golf grip, not to scale.

Referring now to FIGS. 1 and 2, an embodiment of a visual and tactile confirmation golf grip (100) is illustrated. The golf grip (100) generally has a grip length (110), a proximal end (120), a distal end (130), an anterior surface (140), and a posterior surface (150). It should be noted that the anterior surface (140) refers to the surface of a golf grip (100) that has been applied to a golf club that faces away from a golfer when the golf club is soled on a playing surface. The posterior surface (150) is directly opposite the anterior surface (140), and thus would face towards a golfer. For a golfer using a conventional grip, the golfer's thumbs will be positioned proximal to the anterior surface (140) of the golf grip (100) and the golfer's fingers will be wrapped around the posterior surface (150).

Under the current rules of golf, as administered by the United States Golf Association and the Royal and Ancient Golf Club of St Andrews, the golf grip (100) must have a circular cross-section, unless the golf grip (100) is used on a putter type golf club. As shown throughout FIGS. 1-18, the golf grip (100) is depicted as having a flat anterior surface (140), and thus a non-circular cross-section, which is suitable for use on a putter type golf club. However, the golf grip (100) may be constructed with both circular and non-circular cross-sections such that the golf grip (100) conforms to the rules of golf when used on any of the various types of golf clubs.

Still referring to FIG. 1, in one particular embodiment, the golf grip (100) includes an alignment channel (200). The alignment channel (200) extends longitudinally along the anterior surface (140), preferably along the longitudinal center of the anterior surface (140), a predetermined channel length (210). The alignment channel (200) also has a channel width (220) and a channel depth (230), as best seen in FIG. 3.

Figure 3:
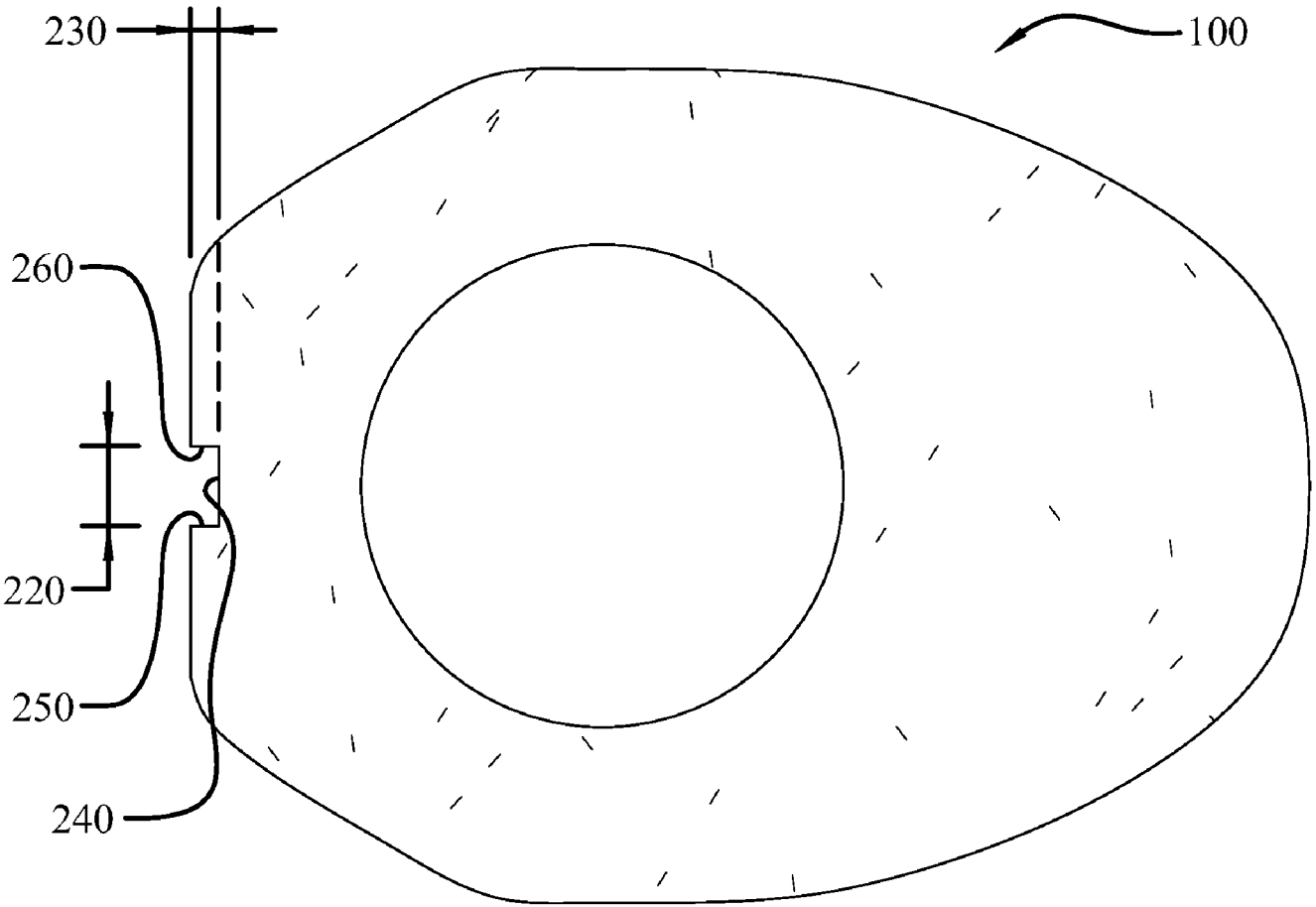
FIG. 3 is a cross-sectional view of the golf grip taken along section line 3-3 of FIG. 2, not to scale.
Figure 4:
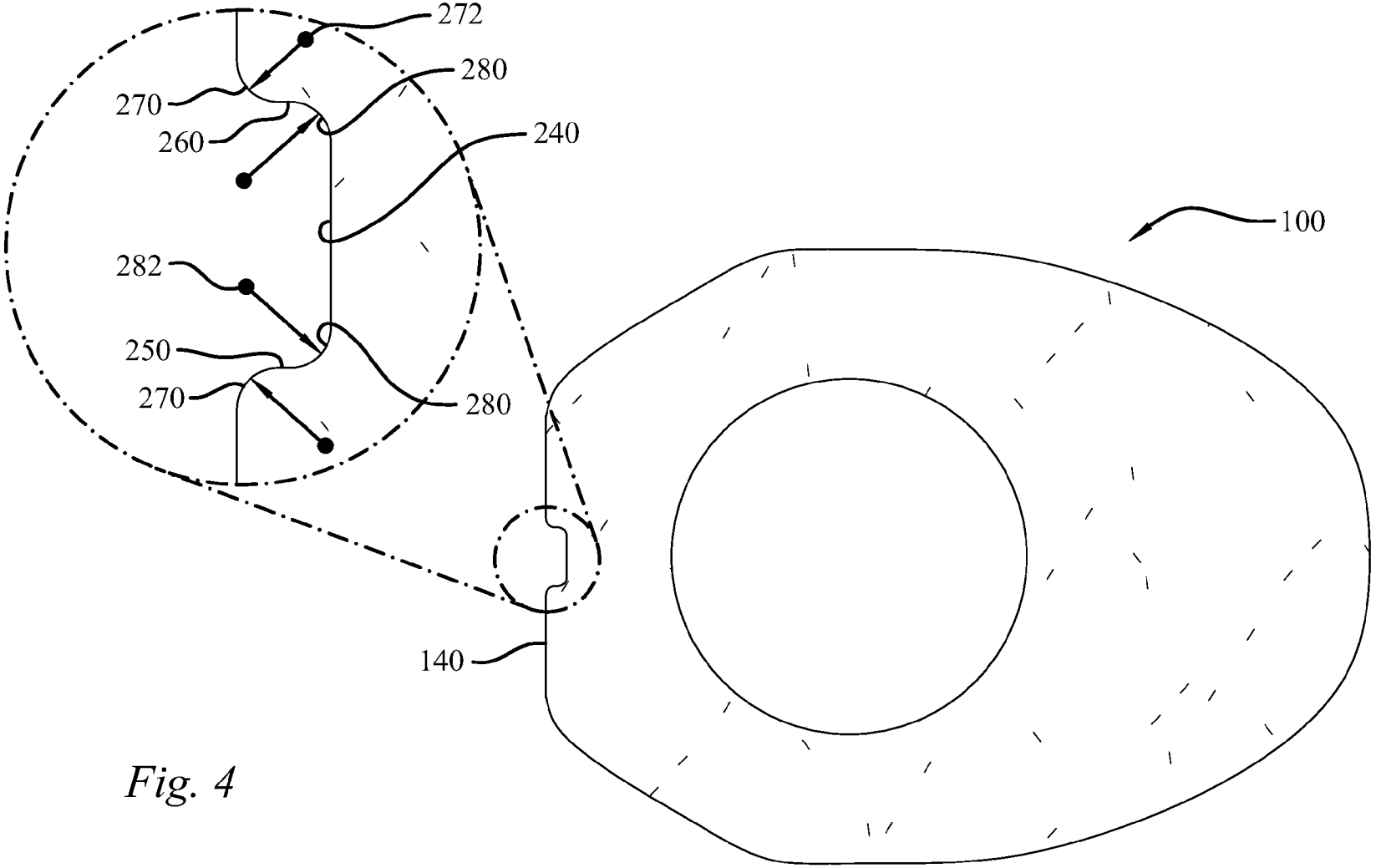
FIG. 4 is a cross-sectional view of an embodiment of a golf grip, not to scale.

Referring to FIG. 3, the alignment channel (200) is defined by a channel bottom wall (240), a channel dextral sidewall (250), and a channel sinistral sidewall (260). As seen in FIG. 4, the channel dextral sidewall (250) and the channel sinistral sidewall (260) are each joined to the anterior surface (140) by an upper channel transition region (270) having an upper channel transition region radius of curvature (272). Similarly, the channel dextral sidewall (250) and the channel sinistral sidewall (260) are each joined to the channel bottom wall (240) by a lower channel transition region (280) having a lower channel transition region radius of curvature (282).

In one particular embodiment, the channel width (220) is at least 1.5 millimeters, and the channel depth (230) is at least 0.5 millimeters. Such dimensions accommodate two-point discrimination, and thus allow a golfer to determine by tactile perception the orientation of the golf grip (100) with respect to the golf club face (10). This feature is especially helpful when applying a golf grip (100) to a golf club as a way to confirm by feel that the golf grip (100) is free of rotational deformities, which is difficult to perceive by "eyeballing."

In another embodiment, the channel width (220) may between 1.5 millimeters and 3.0 millimeters, and the channel depth (230) may be between 0.5 millimeter and 1.0 millimeter. Such dimensions accommodate two-point discrimination, which enables a golfer to determine by tactile perception the orientation of the golf grip (100) with respect to the golf club face (10), yet are not so large as to be distracting.

Because the alignment channel (200) is configured and dimensioned to provide instant feedback as to whether the golf grip (100) is positioned correctly with respect to the golf club face (10), a golfer using the golf grip (100) will have more confidence when making a golf shot. Additionally, the feedback provided by the alignment channel (200) will instantly alert the golfer if the golf grip (100) ever becomes misaligned with respect to the golf club face (10).

Along similar lines, the upper channel transition region (270) and the upper channel transition region radius of curvature (272) also contribute to the ability of determining by tactile perception whether the golf grip (100) is accurately oriented with respect to the golf club face (10). In one embodiment, the upper channel transition region radius of curvature (272) is 0.35 millimeters or less. Such a dimension for the upper channel transition region radius of curvature (272) accommodates two-point discrimination by making the upper channel transition region (270) relatively fine and thus capable of distinction by feel. Preferably, the upper and lower channel transition region radius of curvature (272, 282) are equal to zero, which corresponds to the channel dextral and sinistral sidewalls (250, 260) each joining the anterior surface (140) at a 90 degree angle, and the channel dextral and sinistral sidewalls (250, 260) each joining the channel bottom wall (240) at a 90 degree angle. This specific embodiment provides a pair of distinct sharp edges along the anterior surface (140)

that allows a golfer to confirm by feel whether the golf grip (100) is properly oriented with respect to the golf club face (10).

In addition to confirming by feel that the golf grip (100) is properly oriented with respect to the golf club face (10), the alignment channel (200) also provides a visual indication that the golf grip (100) is properly aligned. For example, in one embodiment, the channel bottom wall (240) may include visual indicia to distinguish the alignment channel (200) from the remainder of the golf grip (100). By way of example, and not limitation, the indicia may be a paint color that contrasts with the overall color of the grip, nylon sparkles, or a strip of reflective material.

In another embodiment, the channel dextral sidewall (250) and the channel sinistral sidewall (260) may include visual indicia. By way of example, and not limitation, the visual indicia may be bright paint colors that contrast with the overall color of the grip, nylon sparkles, or a strip of reflective material. The visual indicia on the channel dextral and sinistral sidewalls (250, 260) may function as a visual indicator and as a training aid. As a visual indicator, the visual indicia on the channel dextral and sinistral sidewalls (250, 260) provides visual feedback regarding whether the golf grip (100) is aligned with the golf club face (10) and whether the golf grip (100) is free of any rotational deformities. For example, if the golf grip (100) has a rotational deformity, a portion of the channel dextral or sinistral sidewall (250, 260) may be visible when looking down the golf grip (100) from a top view.

Moreover, the visual indicia may also be utilized as a training aid. For example, when addressing a golf ball, a golfer may look down at the golf grip (100) to determine whether they have assumed a correct posture and have soled the golf club correctly. If the channel dextral and sinistral sidewalls (250, 260) are visible, then the golfer may make adjustments to correct their posture and how the golf club is soled. When the channel dextral and sinistral sidewalls (250, 260) are no longer visible, then the golfer will know that they are addressing the golf ball correctly and will make their stroke with more confidence.

Additionally, the alignment channel (200) may perform a "reminder" function. For example, when the golf grip (100) is applied in a precise manner with respect to the golf club face (10), a golfer will be able to feel the alignment channel (200) and know whether they are grasping the golf grip (100) with the proper hand and finger placement such that the golf club face (10) is properly aligned. The combination of knowing that the golf grip (100) was precisely aligned and the ability to perceive by feel that the golf grip (100) has been grasped correctly creates a higher level of psychomotor confidence in the golfer, which results in a better golf stroke.

In yet another embodiment, the channel length (210) is at least 50 percent of the grip length (110). Having the alignment channel (200) extend along at least 50 percent of the grip length (110) allows a golfer to determine, both visually and by feel, whether the golf grip (100) is at the desired orientation with respect to the golf club face (10), and especially whether the proximal end (120) and the distal end (130) are aligned and free of rotational deformity. Providing a shorter channel length (210) would allow for a greater possibility of optical illusion or misinterpretation when visually determining if the golf grip (100) is properly aligned. Additionally, a shorter channel length (210) would not provide an accurate indication as to the alignment of the proximal end (120) and the distal end (130) of the golf grip (100), and thus the installed golf grip (100) may have a rotational deformity.

Moreover, an alignment channel (200) that extends along at least 50 percent of the grip length (110) accommodates the numerous styles of hand positioning and gripping used to grasp a golf club, including, but not limited to, a conventional grip, a claw type grip, or a saw type grip. Such a channel length (210) allows a golfer to always have both hands in contact with the alignment channel (200) to receive maximum feedback.

Figure 14:
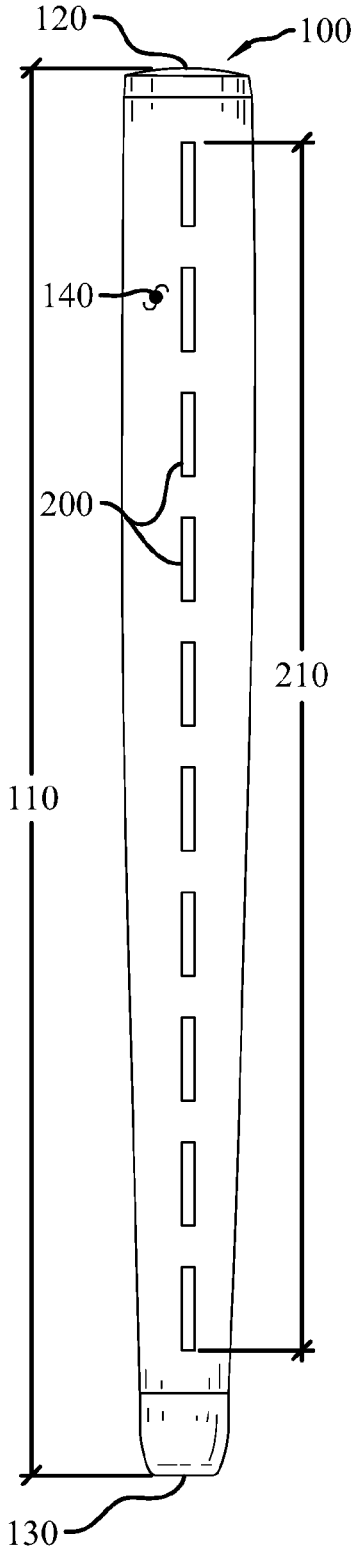
FIG. 14 is a front elevation view of an embodiment of a golf grip, not to scale.

In addition, the alignment channel (200) may comprise two or more non-continuous channels, as seen in FIG. 14. The non-continuous channels may be strategically positioned on the golf grip (100) to coincide with the portions of the golf grip (100) most likely to be contacted by the golfer.

Figure 5:
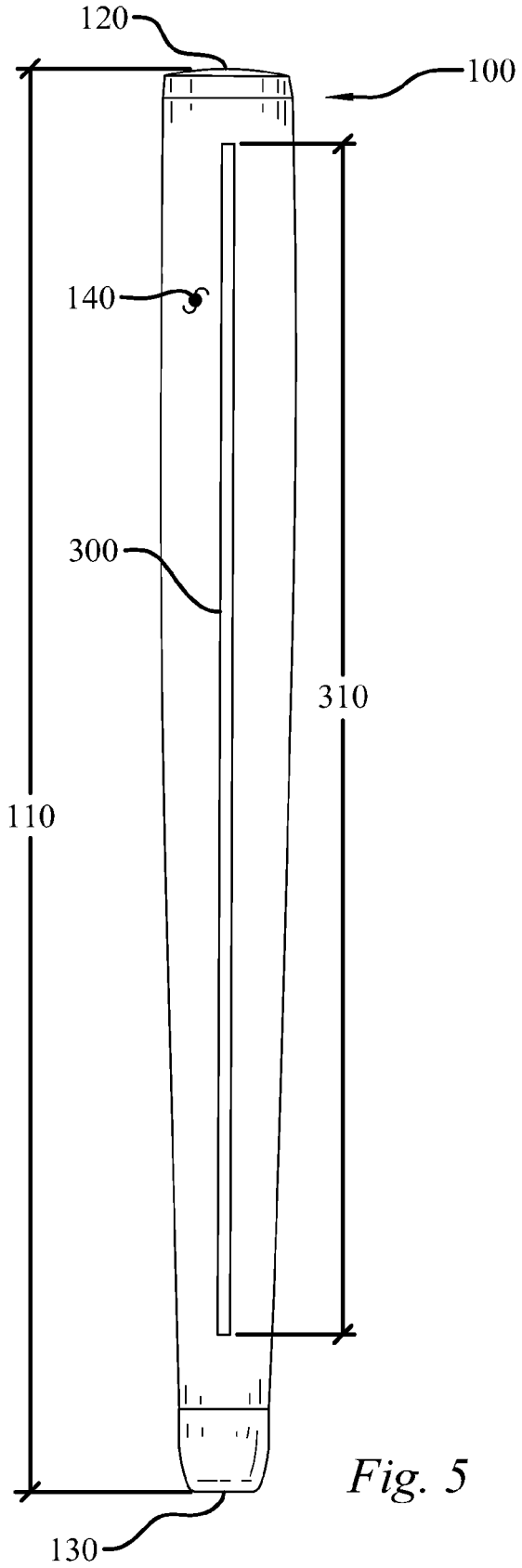
FIG. 5 is a front elevation view of an embodiment of a golf grip, not to scale.
Figure 6:
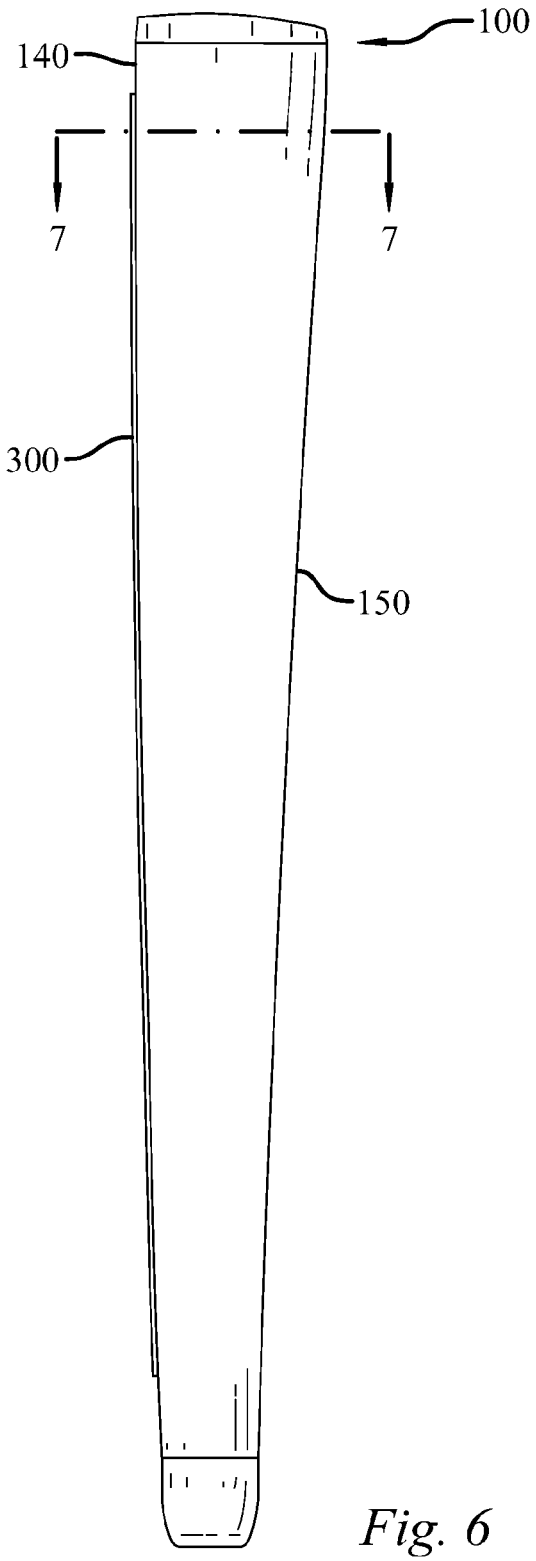
FIG. 6 is a side elevation view of an embodiment of a golf grip, not to scale.

With reference now to FIGS. 5 and 6, still another embodiment of the visual and tactile confirmation golf grip (100) is shown. The golf grip (100) generally has a grip length (110), a proximal end (120), a distal end (130), an anterior surface (140), and a posterior surface (150). It should be noted that the anterior surface (140) refers to the surface of a golf grip (100) that has been applied to a golf club that faces away from a golfer when the golf club is soled on a playing surface. The posterior surface (150) is directly opposite the anterior surface (140), and thus would face towards a golfer. For a golfer using a conventional grip, the golfer's thumbs will be positioned proximal to the anterior surface (140) of the golf grip (100) and the golfer's fingers will be wrapped around the posterior surface (150).

Still referring to FIG. 5, in a particular embodiment, the golf grip (100) includes an alignment projection (300). The alignment projection (300) extends longitudinally along the anterior surface (140), preferably along the longitudinal center of the anterior surface (140), a predetermined projection length (310). The alignment projection (300) also has a projection width (320) and a projection height (330), as best seen in FIG. 7.

Figure 7:
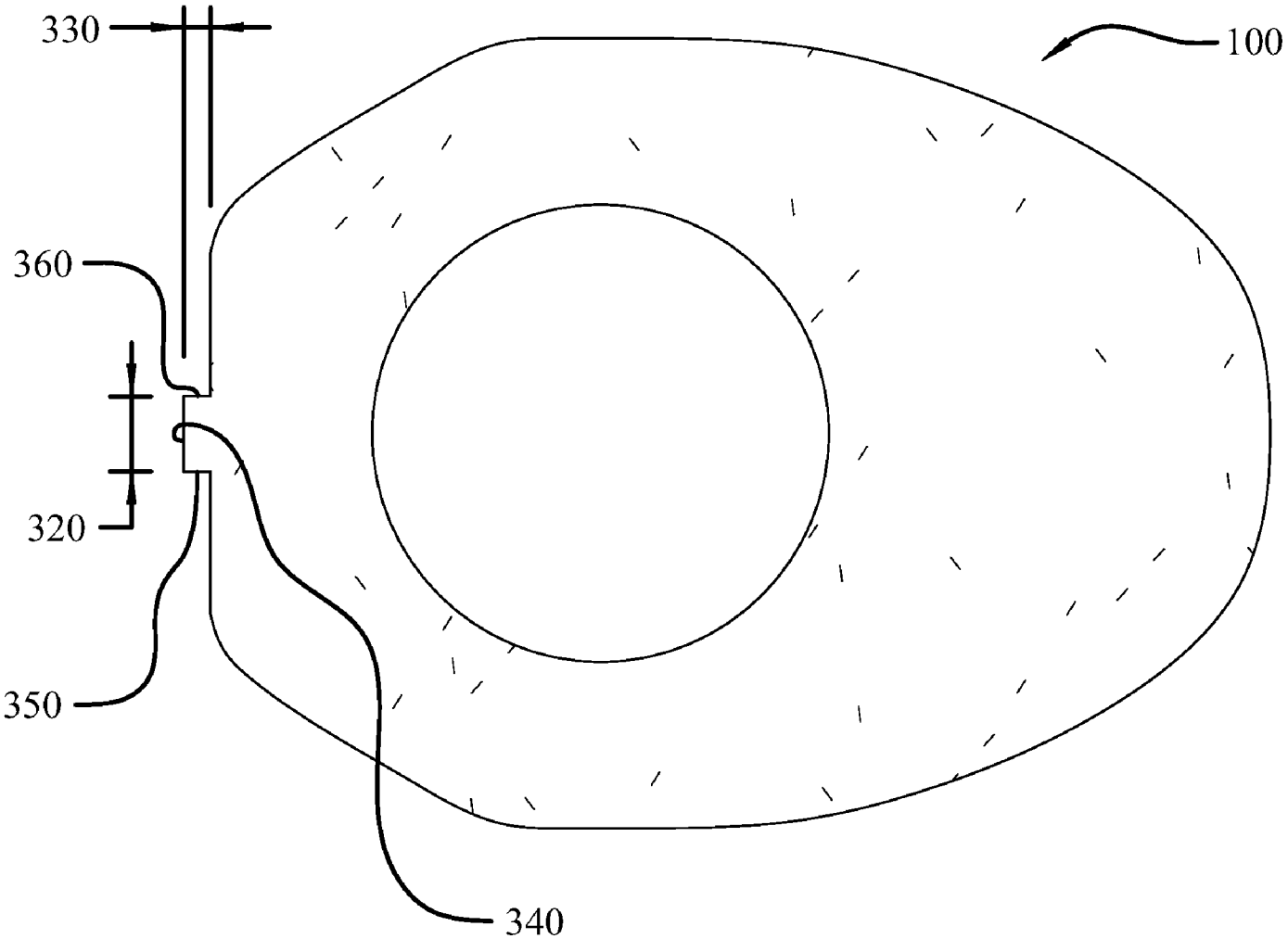
FIG. 7 is a cross-sectional view of the golf grip taken along section line 7-7 of FIG. 6, not to scale.
Figure 8:
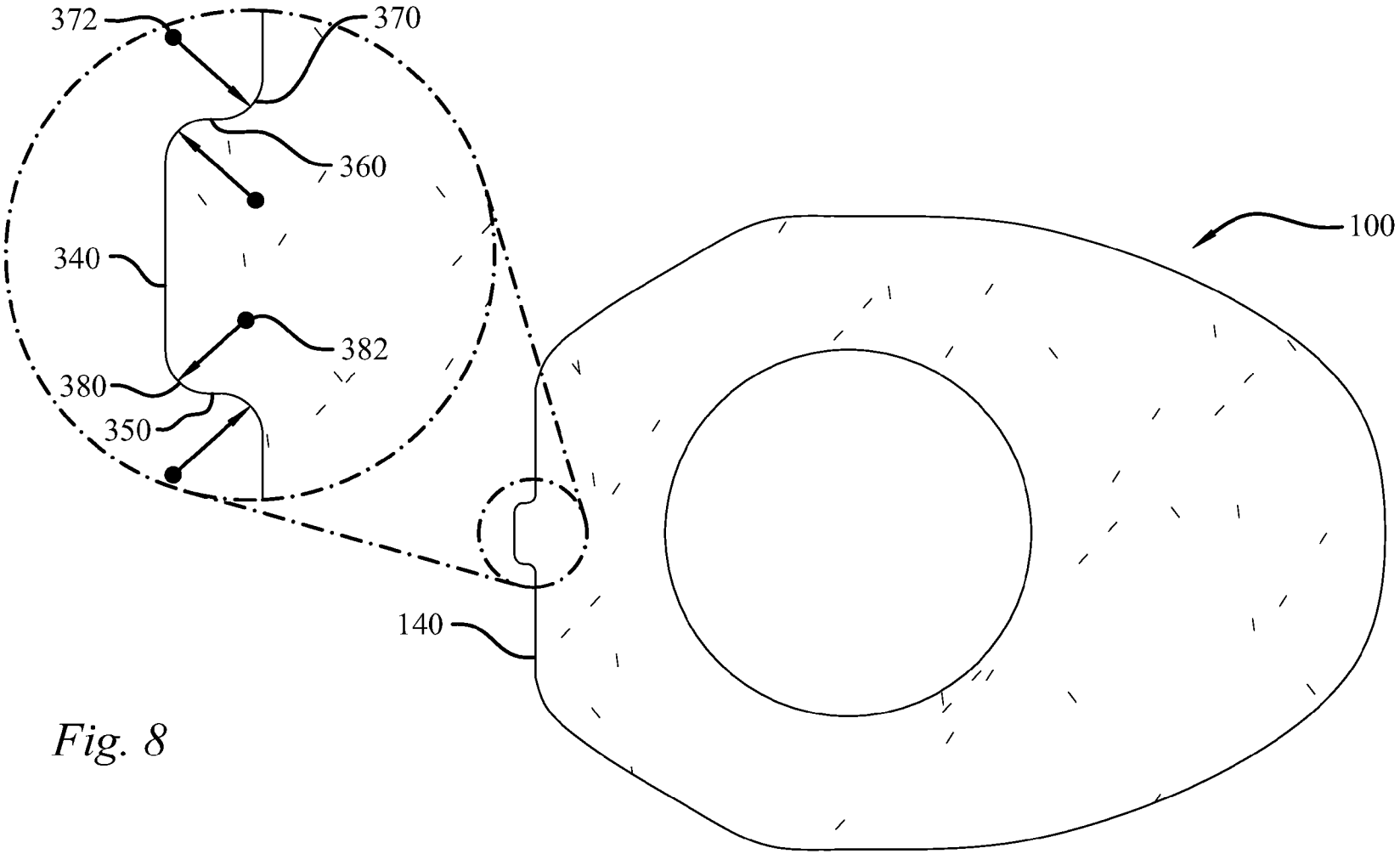
FIG. 8 is a cross-sectional view of an embodiment of a golf grip, not to scale.

Referring to FIG. 7, the alignment projection (300) is defined by a projection top wall (340), a projection dextral sidewall (350), and a projection sinistral sidewall (360). As seen in FIG. 8, the projection dextral sidewall (350) and the projection sinistral sidewall (360) are each joined to the anterior surface (140) by a lower projection transition region (370) having a lower projection transition region radius of curvature (372). Similarly, the projection dextral sidewall (350) and the projection sinistral sidewall (360) are each joined to the projection top wall (340) by an upper projection transition region (380) having an upper projection transition region radius of curvature (382).

In one particular embodiment, the projection width (320) is at least 1.5 millimeters, and the projection height (330) is at least 0.5 millimeters. Such dimensions accommodate two-point discrimination, and thus allow a golfer to determine by tactile perception the orientation of the golf grip (100) with respect to the golf club face (10). This feature is especially helpful when applying a golf grip (100) to a golf club as a way to confirm by feel that the golf grip (100) is free of any rotational deformity.

In another embodiment, the projection width (320) may between 1.5 millimeters and 3.0 millimeters, and the projection height (330) may be between 0.5 millimeter and 1.0 millimeter. Such dimensions accommodate two-point discrimination, which enables a golfer to determine by tactile perception the orientation of the golf grip (100) with respect to the golf club face (10).

Because the alignment projection (300) is configured and dimensioned to provide instant feedback as to whether the golf grip (100) is positioned correctly with respect to the golf club face (10), a golfer using the golf grip (100) will have more confidence when making a golf shot. Additionally, the feedback provided by the alignment projection (300) will instantly alert the golfer if the golf grip (100) ever becomes misaligned with respect to the golf club face (10).

Along similar lines, the upper projection transition region (380) and the upper projection transition region radius of curvature (382) also contribute to the ability of determining by tactile perception whether the golf grip (100) is accurately oriented with respect to the golf club face (10). In one embodiment, the upper projection transition region radius of curvature (382) is 0.35 millimeters or less. Such a dimension for the upper projection transition region radius of curvature (382) accommodates two-point discrimination by making the upper projection transition region (380) relatively fine and thus capable of distinction by feel. Preferably, the upper and lower projection transition region radius of curvature (382, 372) are equal to zero, which corresponds to the projection dextral and sinistral sidewalls (350, 360) each joining the projection top wall (340) at a 90 degree angle, and the projection dextral and sinistral sidewalls (350, 360) each joining the anterior surface (140) at a 90 degree angle. This specific embodiment provides a pair of distinct sharp edges that are raised above the anterior surface (140) that allows a golfer to confirm by feel whether the golf grip (100) is properly oriented with respect to the golf club face (10).

In addition to confirming by feel that the golf grip (100) is properly oriented with respect to the golf club face (10), the alignment projection (300) also provides a visual indication that the golf grip (100) is properly aligned. For example, in one embodiment, the projection top wall (340) may include visual indicia to distinguish the alignment projection (300) from the remainder of the golf grip (100). By way of example, and not limitation, the visual indicia may be a paint color that contrasts with the overall color of the grip, nylon sparkles, or a strip of reflective material.

In another embodiment, the projection dextral sidewall (350) and the projection sinistral sidewall (360) may include visual indicia. By way of example, and not limitation, the visual indicia may be bright paint colors that contrast with the overall color of the grip, nylon sparkles, or a strip of reflective material. The visual indicia on the projection dextral and sinistral sidewalls (350, 360) may function as a visual indicator and as a training aid. As a visual indicator, the visual indicia on the projection dextral and sinistral sidewalls (350, 360) provides visual feedback regarding whether the golf grip (100) is aligned with the golf club face (10) and whether the golf grip (100) is free of any rotational deformities. For example, if the golf grip (100) has a rotational deformity, a portion of the projection dextral or sinistral sidewall (350, 360) may be visible when looking down the golf grip (100) from a top view.

Furthermore, the visual indicia may also be utilized as a training aid. For example, when addressing a golf ball, a golfer may look down at the golf grip (100) to determine whether they have assumed a correct posture and have soled the golf club correctly. If the projection dextral and sinistral sidewalls (350, 360) are visible, then the golfer may make adjustments to correct their posture and how the golf club is soled. When the projection dextral and sinistral sidewalls (350, 360) are no longer visible, then the golfer will know that they are addressing the golf ball correctly and will make their stroke with more confidence.

Additionally, the alignment projection (300) performs a "reminder" function. For example, when the golf grip (100) is applied properly with respect to the golf club face (10), a golfer will be able to feel the alignment projection (300) and know whether they are grasping the golf grip (100) with the proper hand and finger placement such that the golf club face (10) is properly aligned. The combination of knowing that the golf grip (100) was precisely aligned and the ability to perceive by feel that the golf grip (100) has been grasped correctly creates a higher level of psychomotor confidence in the golfer, which results in a better golf stroke.

In yet another embodiment, the projection length (310) is at least 50 percent of the grip length (110). Having the alignment projection (300) extend along at least 50 percent of the grip length (110) allows a golfer to determine, both visually and by feel, whether the golf grip (100) is at the desired orientation with respect to the golf club face (10), and especially whether the proximal end (120) and the distal end (130) are aligned and free of rotational deformity. Providing a shorter projection length (310) would allow for a greater possibility of optical illusion or misinterpretation when visually determining if the golf grip (100) is properly aligned. Additionally, a short projection length (310) would not provide an accurate indication as to the alignment of the proximal end (120) and the distal end (130) of the golf grip (100), and would likely result in the installed golf grip (100) having rotational deformities.

Moreover, an alignment projection (300) that extends along at least 50 percent of the grip length (110) accommodates the numerous styles of hand positioning and gripping used to grasp a golf club, especially a putter type golf club. Such a projection length (310) allows a golfer to always have both hands in contact with the alignment projection (300) to receive maximum feedback.

Figure 16:
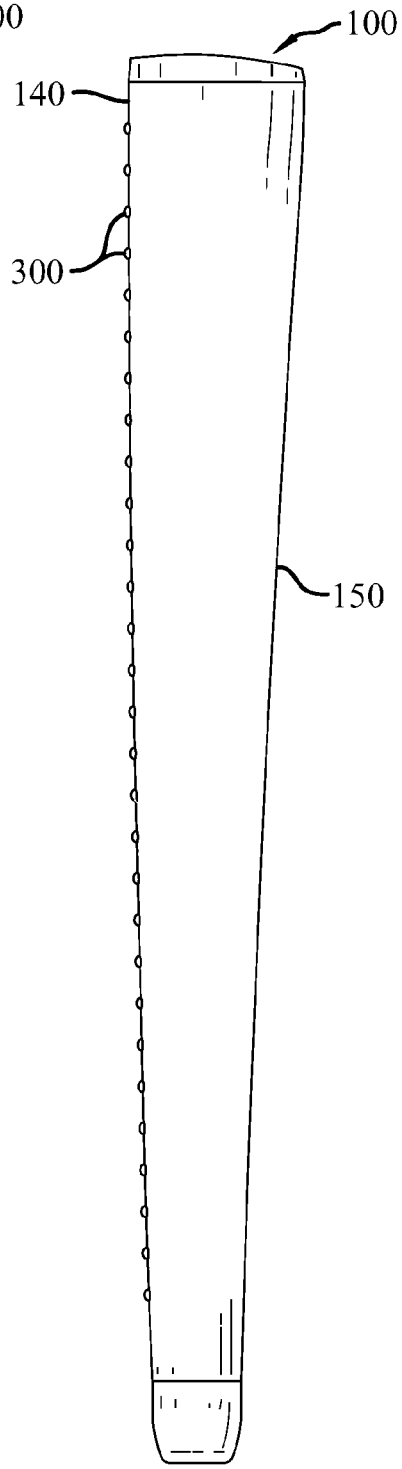
FIG. 16 is a side elevation view of an embodiment of a golf grip, not to scale.

In addition, the alignment projection (300) may comprise two or more non-continuous projections. The non-continuous projections may be strategically positioned on the golf grip (100) to coincide with the portions of the golf grip (100) most likely to be contacted by a golfer. In one embodiment, the non-continuous projections may be a series of braille-like dots, as seen in FIG. 16.

Although the visual and tactile confirmation golf grip (100) has been illustrated and described as having an alignment channel (200) or an alignment projection (300) extending longitudinally along the anterior surface (140), additional embodiments are contemplated. For example, in one particular embodiment, the golf grip (100) may include an alignment channel (200) extending longitudinally along the anterior surface (140) and an alignment projection (300) extending longitudinally along a posterior surface (150) of the golf grip (100). In this embodiment, a golfer may use the alignment channel (200) in connection with the alignment projection (300) to confirm with more precision that the golf grip (100) has been applied without rotational deformity and is in a desired orientation relative to the golf club face (10).

Figure 18:
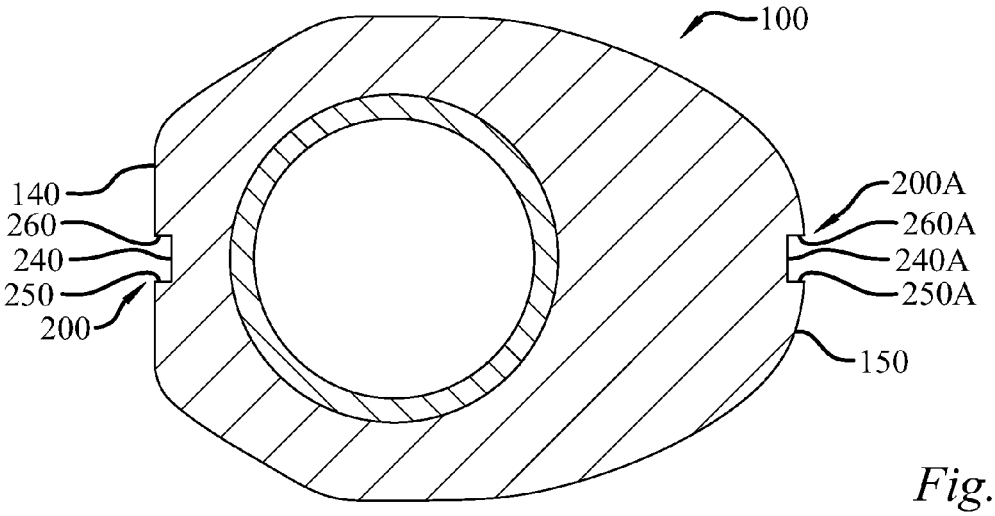
FIG. 18 is a cross-sectional view of an embodiment of a golf grip, not to scale.

Furthermore, the alignment projection (300) may be utilized as a "reminder" for proper hand and finger placement. One with skill in the art will appreciate that additional combinations of the alignment channel (200) and the alignment projection (300) on the anterior surface (140) and posterior surface (150) may be successfully employed, such as an alignment channel (200) on both the anterior and posterior surfaces (140, 150), as seen in FIG. 18, an alignment projection (300) on both the anterior and posterior surfaces (140, 150), or an alignment projection (300) on the anterior surface (140) and an alignment channel (200) on the posterior surface (150).

Figure 17:
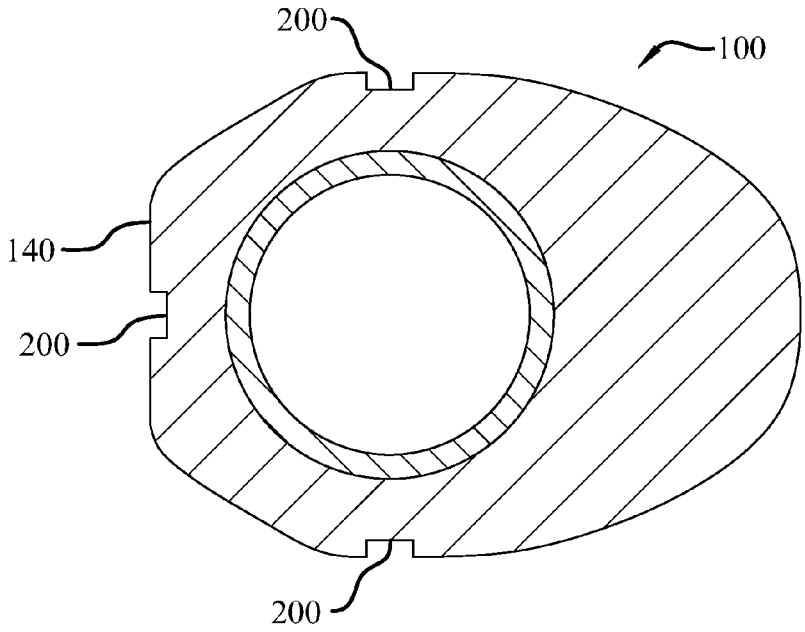
FIG. 17 is a cross-sectional view of an embodiment of a golf grip, not to scale.

In yet another embodiment, the golf grip (100) may further include an alignment channel (200) or an alignment projection (300) extending longitudinally along the side surfaces of the golf grip (100), as best seen in FIG. 17. In this embodiment, the alignment channel (200) or alignment projection (300) is configured to extend longitudinally along the areas of the golf grip (100) that will most likely be contacted by a golfer's fingertips. For example, a golfer using a conventional right-handed grip, or a left-handed golfer using a cross-handed grip, would contact the golf grip (100) at a lower left side portion of the golf grip (100) with their right hand fingertips, and they would contact the golf grip (100) at an upper right side portion of the golf grip (100) with their left hand fingertips. Thus, in one embodiment, the golf grip (100) may have an alignment channel (200) or an alignment projection (300) at a lower left side portion of the golf grip (100) and at an upper right side portion of the golf grip (100).

Conversely, a golfer using a conventional left-handed grip, or a right-handed golfer using a cross-handed grip, would contact the golf grip (100) at a lower right side portion of the golf grip (100) with their left hand fingertips, and they would contact the golf grip (100) at an upper left side portion of the golf grip (100) with their right hand fingertips. Thus, in another embodiment, the golf grip (100) may have an alignment channel (200) or an alignment projection (300) at a lower right side portion of the golf grip (100) and at an upper left side portion of the golf grip (100).

In yet another embodiment, the alignment channel (200) or an alignment projection (300) may extend longitudinally along at least 50 percent of the length of the side surfaces of the golf grip (100). This particular embodiment allows for a golfer's fingertips to be in contact with the alignment channel (200) or alignment projection (300) regardless of whether the golfer uses a conventional right-handed or left-handed grip.

By providing an alignment channel (200) or an alignment projection (300) along the side surfaces of the golf grip, the opportunity for the golfer's finger tips to contact the alignment channel (200) or alignment projection (300) is maximized. Since the fingertips are the most sensitive portion of the golfer touching the golf grip (100), the golfer's ability to determine by tactile perception the orientation of the golf grip (100) with respect to the golf club face (10) is likewise maximized. Repeated use of the golf grip (100) will build motor memory and will give the golfer more confidence that they are aligning the golf club face (10) correctly.

Figure 15:
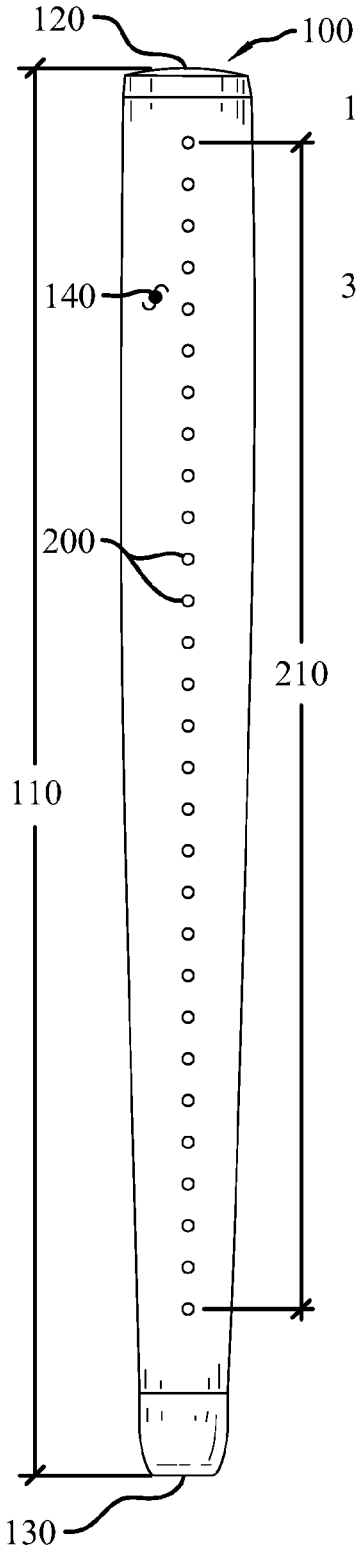
FIG. 15 is a front elevation view of an embodiment of a golf grip, not to scale.

Moreover, it is contemplated that additional geometries of the alignment channel (200) and the alignment projection (300) may be successfully utilized. By way of example, and not limitation, the alignment projection (300) may have a substantially circular cross-section, and the alignment channel (200) may have a U-shaped cross-section. In addition, the alignment channel (200) need not be a "channel" per se; rather, the alignment channel (200) may be configured as a series of small dimples or depressions that are continuous or non-continuous, as seen in FIG. 15.

Figure 19:
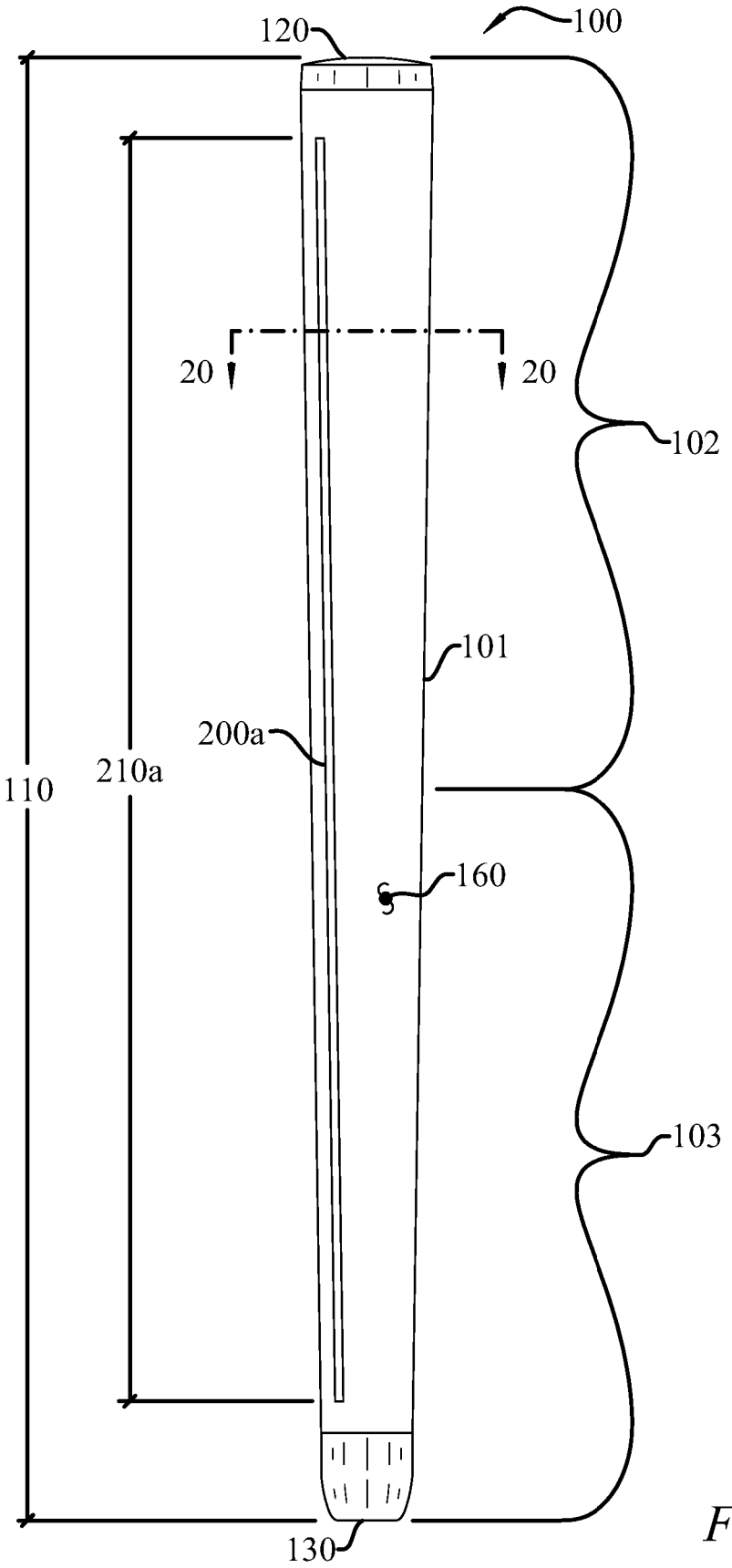
FIG. 19 is a front elevation view of an embodiment of a golf grip, not to scale.
Figure 20:
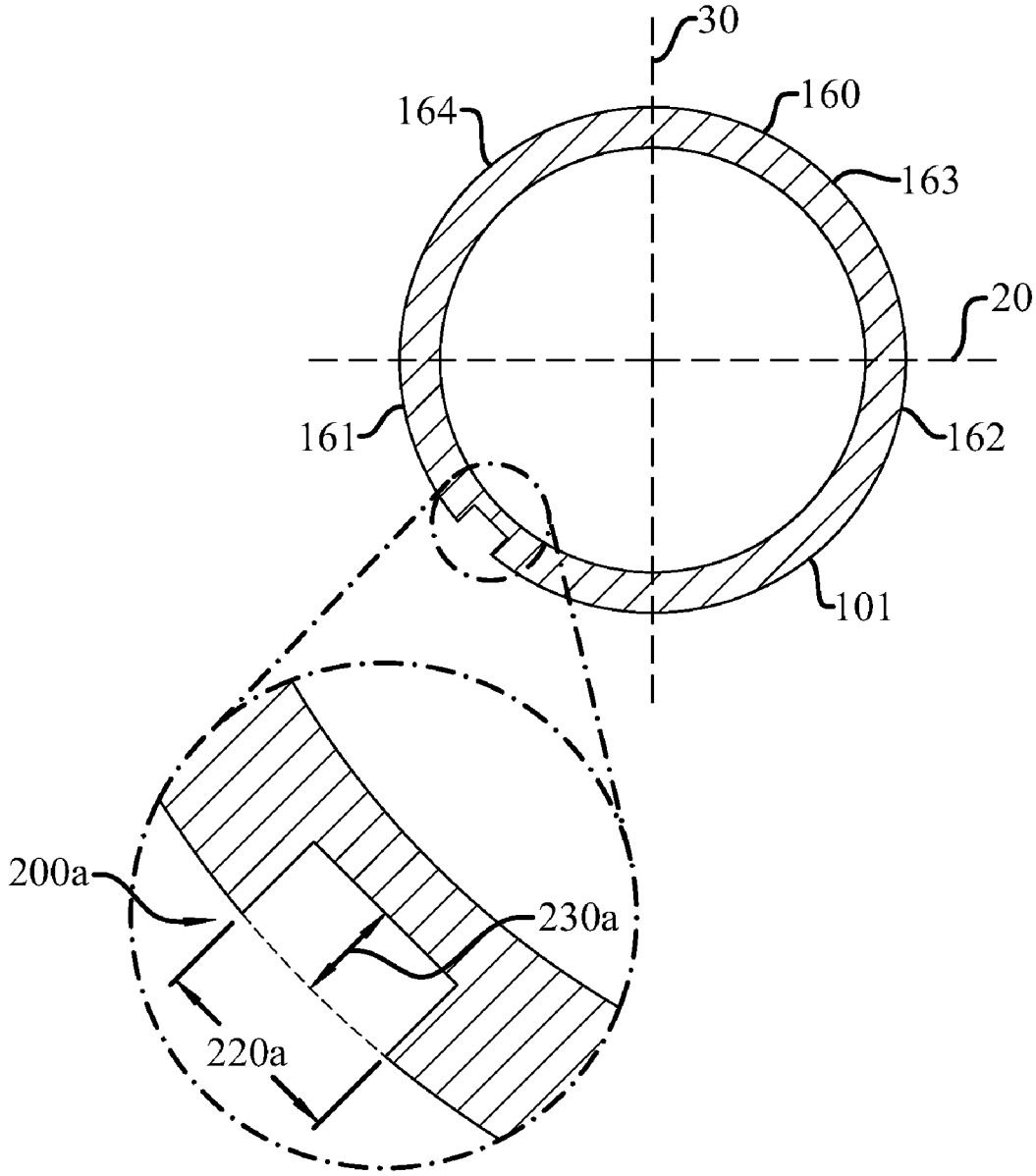
FIG. 20 is a cross-sectional view of the embodiment of the golf grip shown in FIG. 19 taken along section line 20-20, not to scale.

With reference now to FIGS. 19 and 20, an additional embodiment of the golf grip (100) is shown. As seen in FIG. 19, the golf grip (100) includes a grip body (101) having an upper portion (102), a lower portion (103), a grip length (110), a proximal end (120), a distal end (130), and an exterior body surface (160). The grip body (101) is configured to be disposed about an outer surface of a golf club shaft (not shown). The upper portion (102) and the lower portion (103) correspond to the portion of the grip body (101) that is above the midpoint of the grip length (110) and below the midpoint of the grip length (110), respectively. Generally, for a right-handed golfer using a conventional gripping style, the upper portion (102) is where a majority of the golfer's left hand would grasp the golf grip (100) and the lower portion (103) is where a majority of the golfer's right hand would grasp the golf grip (100). As seen in FIGS. 19 and 20, the grip body (101) has a substantially circular cross-section throughout the grip length (110); however, the grip body (101) may have a non-circular cross-section throughout a substantial portion of the grip length (110).

Figure 28:
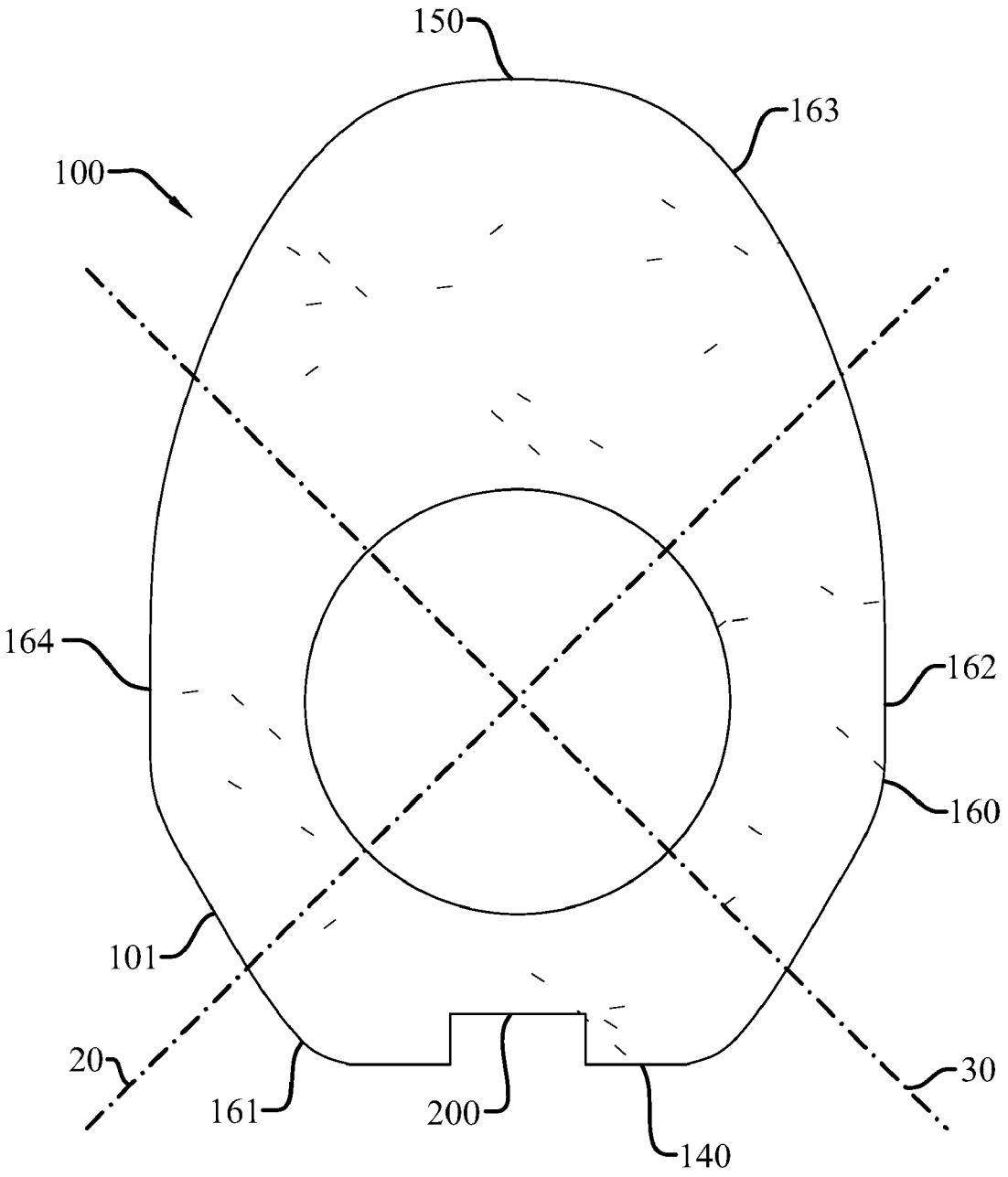
FIG. 28 is a cross-sectional view of an embodiment of a golf grip, not to scale.

Still referring to FIGS. 19 and 20, the exterior body surface (160) is defined by a first quadrant (161), a second quadrant (162), a third quadrant (163), and a fourth quadrant (164). The quadrants (161, 162, 163, 164) are defined by an imaginary first vertical plane (20) that orthogonally intersects an imaginary second vertical plane (30), as seen well in FIG. 20. Preferably, the first vertical plane (20) and the second vertical plane (30) intersect at the geometric center of the proximal end (120), i.e., the butt end, of the grip (100) from a top plan view. The first vertical plane (20) and the second vertical plane (30) may be rotated about the geometric center of the proximal end (120) to define a position of the quadrants (161, 162, 163, 164). Preferably, for a grip body (101) that has a non-circular cross-section throughout a substantial portion, i.e., greater than 50 percent, of the grip length (110), such as a putter type grip having a flat anterior surface (140), the quadrants (161, 162, 163, 164) are defined such that the flat anterior surface (140) is bound by a single quadrant (161, 162, 163, 164), as seen in FIG. 28. Moreover, the golf grip (100) may include visual indicia, such as painted lines, on the exterior body surface (160) that visually delineates the quadrants (161, 162, 163, 164).

In the embodiment shown in FIG. 19, the golf grip (100) includes a first alignment channel (200*a*) extending longitudinally along the exterior body surface (160). The first alignment channel (200*a*) has a first channel length (210*a*), a first channel width (220*a*), and a first channel depth (230*a*), as seen in FIGS. 19 and 20. The first alignment channel (200*a*) is confined to a first alignment quadrant selected from the group consisting of the first quadrant (161), the second quadrant (162), the third quadrant (163), and the fourth quadrant (164). As seen in FIG. 20, in this embodiment the first alignment quadrant is the first quadrant (161) and the first alignment channel (200*a*) is confined to the first quadrant (161). However, the first alignment quadrant could also be the second quadrant (162), the third quadrant (163), or the fourth quadrant (164).

In this particular embodiment, there is only the first alignment channel (200*a*) in the first alignment quadrant. It should be noted that while this particular embodiment includes "only" the first alignment channel (200*a*) in the first alignment quadrant, this does not mean that the exterior body surface (160) cannot have additional surface patterns, texture changes, or other similar features. When the term "only" is used in connection with describing the alignment channels (200*a*, 200*b*, 200*c*, 200*d*) in certain alignment quadrants, it means that the alignment quadrants do not contain any additional features having a depth of at least 0.4 millimeters or a width of at least 1.0 millimeters. Thus, a golf grip (100) having only the first alignment channel (200*a*) in the first alignment quadrant may also have textures and features that correspond to a conventional spiral wound grip.

In one particular embodiment, the first channel width (220*a*) is at least 2.0 millimeters, and the first channel depth (230*a*) is at least 0.5 millimeters. In another preferred embodiment the first channel depth (230*a*) is between twenty-five percent and fifty percent of the first channel width (220*a*). Such dimensions accommodate two-point discrimination, and thus allow a golfer to tactilely perceive the first alignment channel (200*a*), while not reducing the torsion resistance of the grip (100). Moreover, these dimensions accommodate water run off when the grip (100) is used in rainy weather conditions and also facilitates sweat run off. Further, these dimensions assist the golfer in holding the grip (100) and provide the grip (100) with an anti-torsion effect that helps keep the grip (100) from rotating in a golfer's hands during use.

Figure 34:
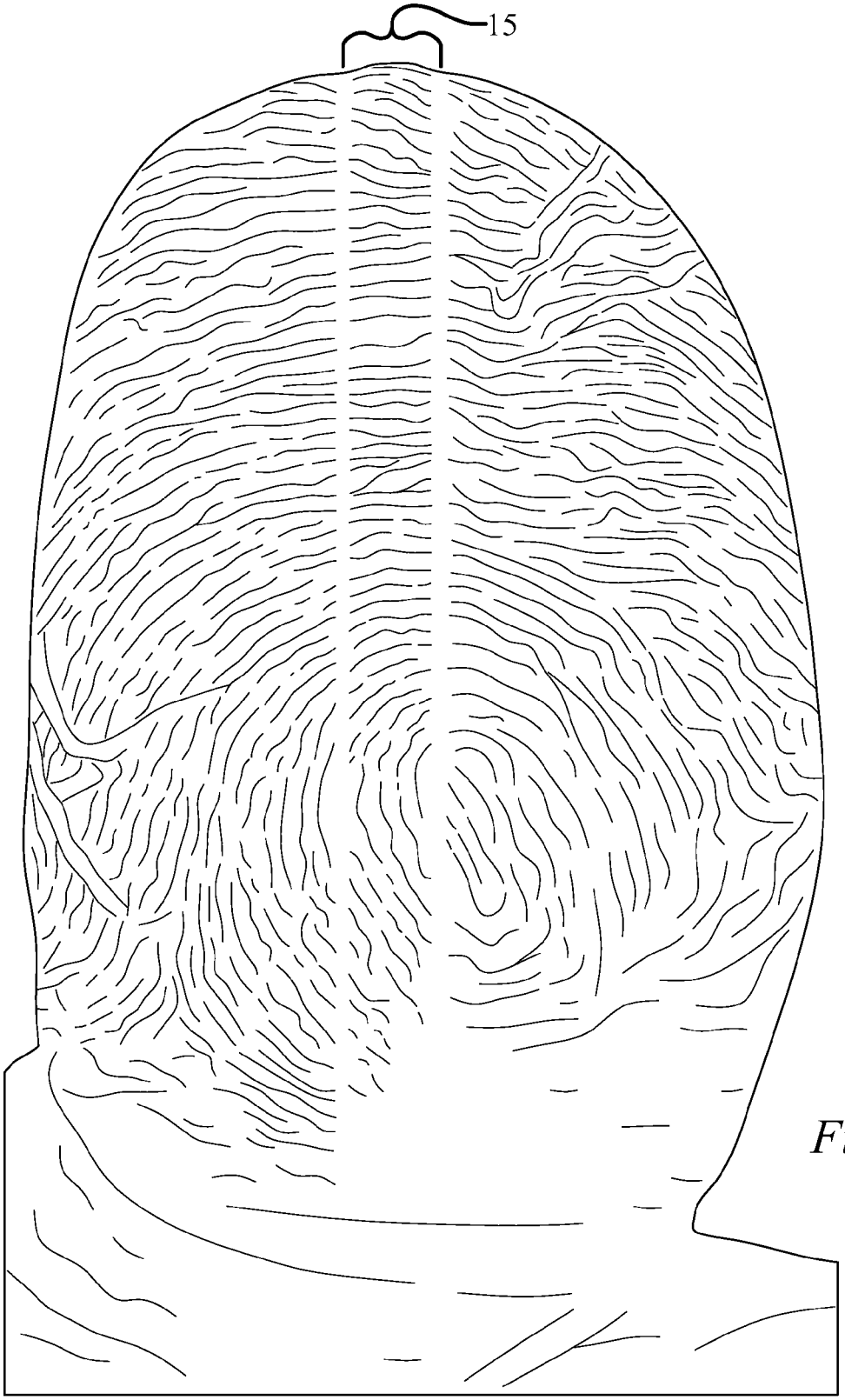
FIG. 34 is an elevation view of a golfer's thumb showing a dermal imprint, not to scale.

The golf grip (100) may be selectively applied to a golf club shaft (not shown) such that the first alignment channel (200*a*) coincides with a pre-selected, golfer preferred, hand and finger placement on the golf grip (100). As such, the first alignment channel (200*a*) additionally performs a "reminder" function. For example, when the golf grip (100) is selectively applied to a golf club shaft, the golfer will be able to feel the first alignment channel (200*a*) and know whether they are grasping the golf grip (100) with their preferred hand and finger placement on the golf grip (100). By knowing that the first alignment channel (200*a*) coincides with the preferred hand and finger placement and being able to tactilely perceive the first alignment channel (200*a*), the golfer will have a higher level of psychomotor confidence, which results in a better golf stroke. In fact, when the golfer grasps the golf grip (100), the skin of their fingers or hand will minimally sink into the alignment channel (200*a*). As seen in FIG. 34, a dermal imprint (15) is formed when grasping the golf grip (100). The dermal imprint (15) provides a very subtle and precise psychomotor alignment "read" for the golfer at the microdermal neurosensory level, which ultimately leads to better golf strokes.

Figure 32:
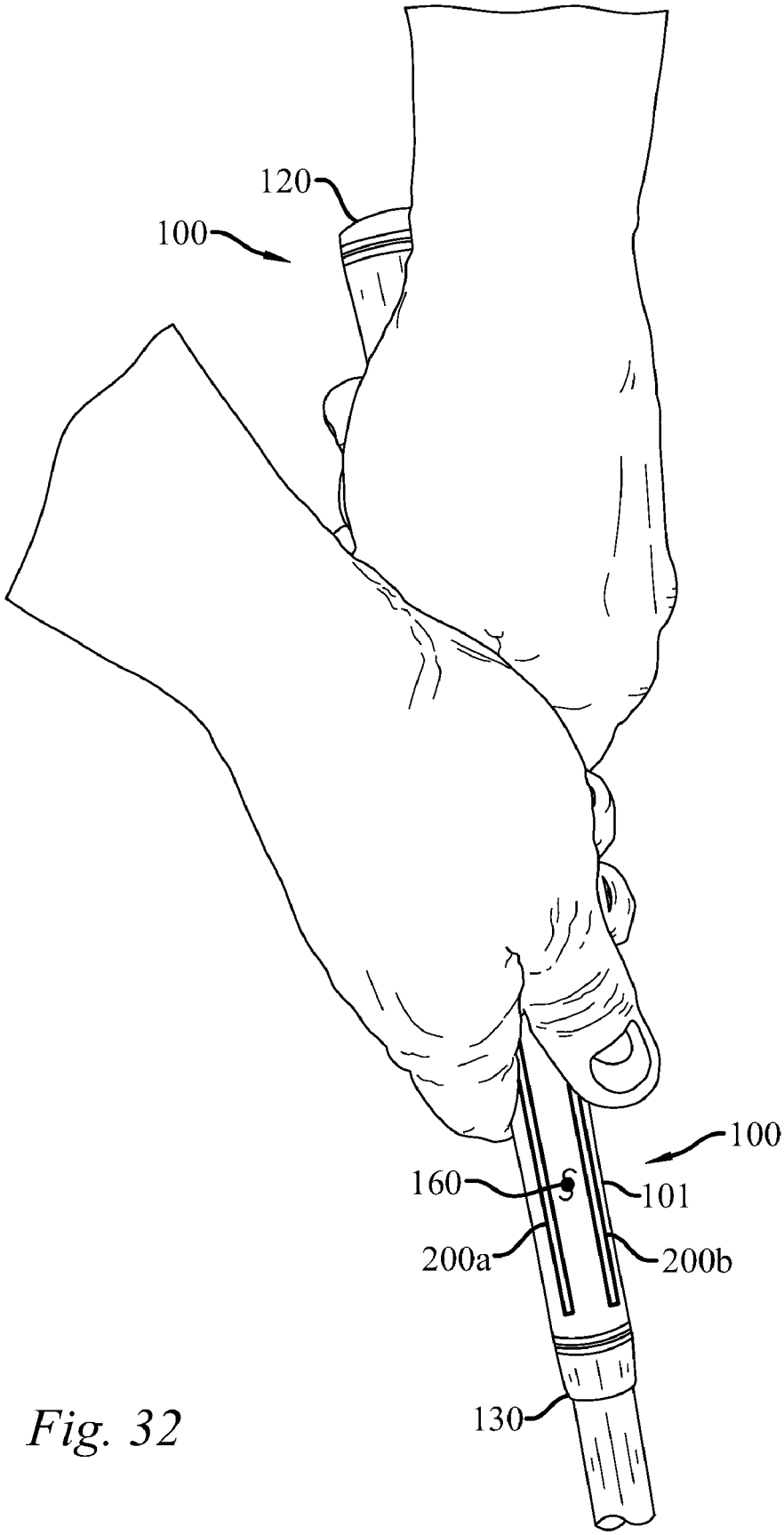
FIG. 32 is an elevation view of an embodiment of a golf grip being held by a golfer with a strong gripping style, not to scale.
Figure 33:
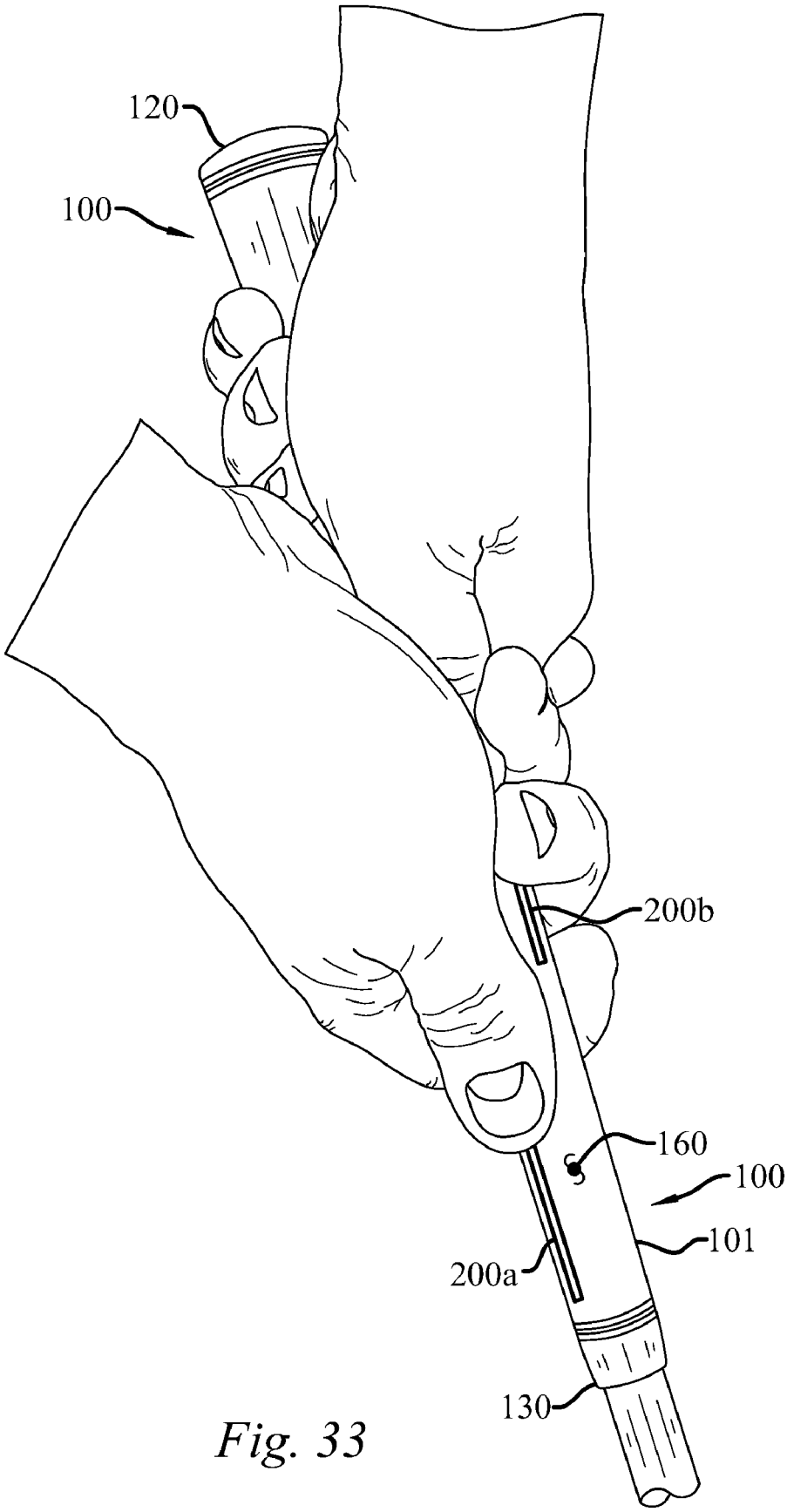
FIG. 33 is an elevation view of an embodiment of a golf grip being held by a golfer with a weak gripping style, not to scale.

In yet another embodiment, the first channel length (210*a*) is at least 50 percent of the grip length (110). Having the first alignment channel (200*a*) extend along at least 50 percent of the grip length (110) allows a golfer to determine, both visually and by feel, whether the golf grip (100) has been applied to the golf club shaft in such a way that the proximal end (120) and the distal end (130) are aligned and free of rotational deformity. Moreover, providing a first alignment channel (200*a*) that extends along at least 50 percent of the grip length (110) accommodates the numerous styles of hand positioning and gripping used to grasp a golf club, including, but not limited to, a conventional grip, a strong gripping style, as seen in FIG. 32, a weak gripping style, as seen in FIG. 33, a claw type grip, or a saw type grip. Such a first channel length (210*a*) maximizes the opportunity for the golfer's hands and fingers to come into contact with the first alignment channel (200*a*) to receive maximum psychomotor feedback.

Figure 21:
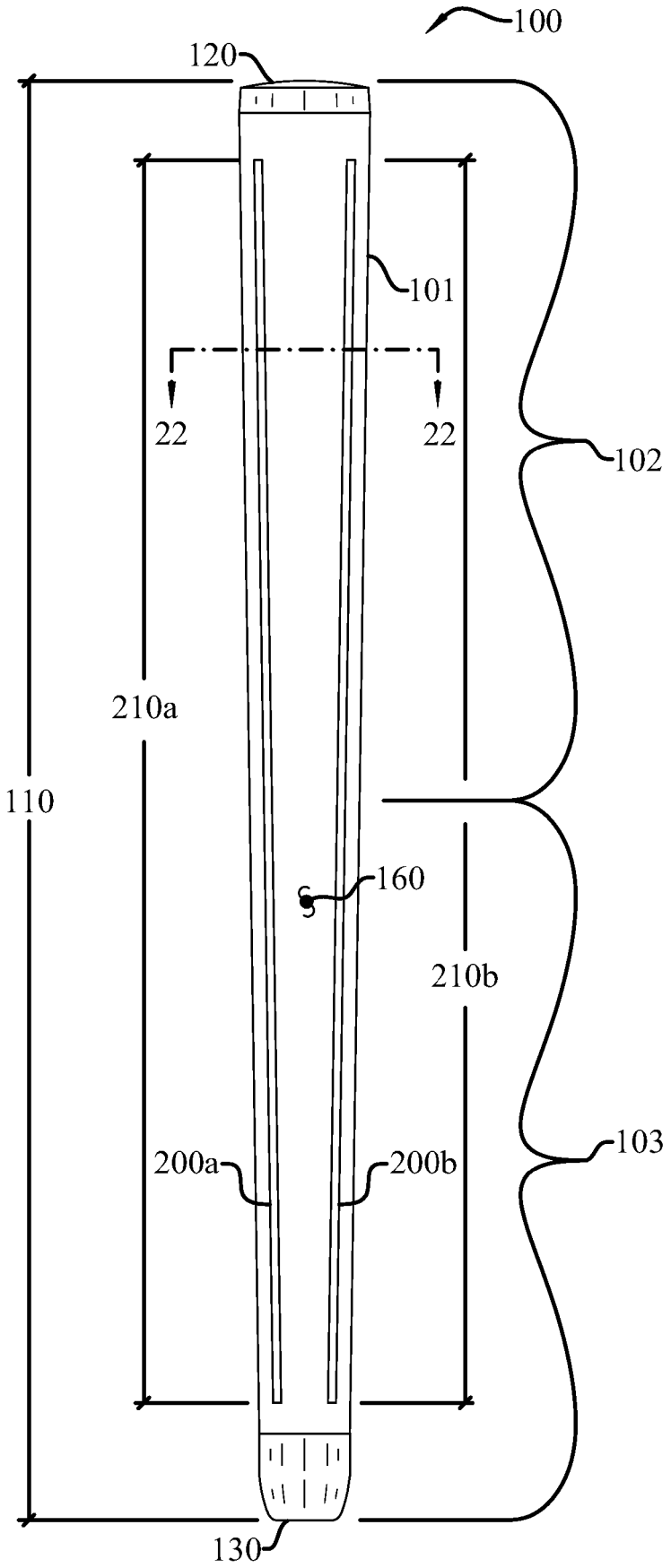
FIG. 21 is a front elevation view of an embodiment of a golf grip, not to scale.
Figure 22:
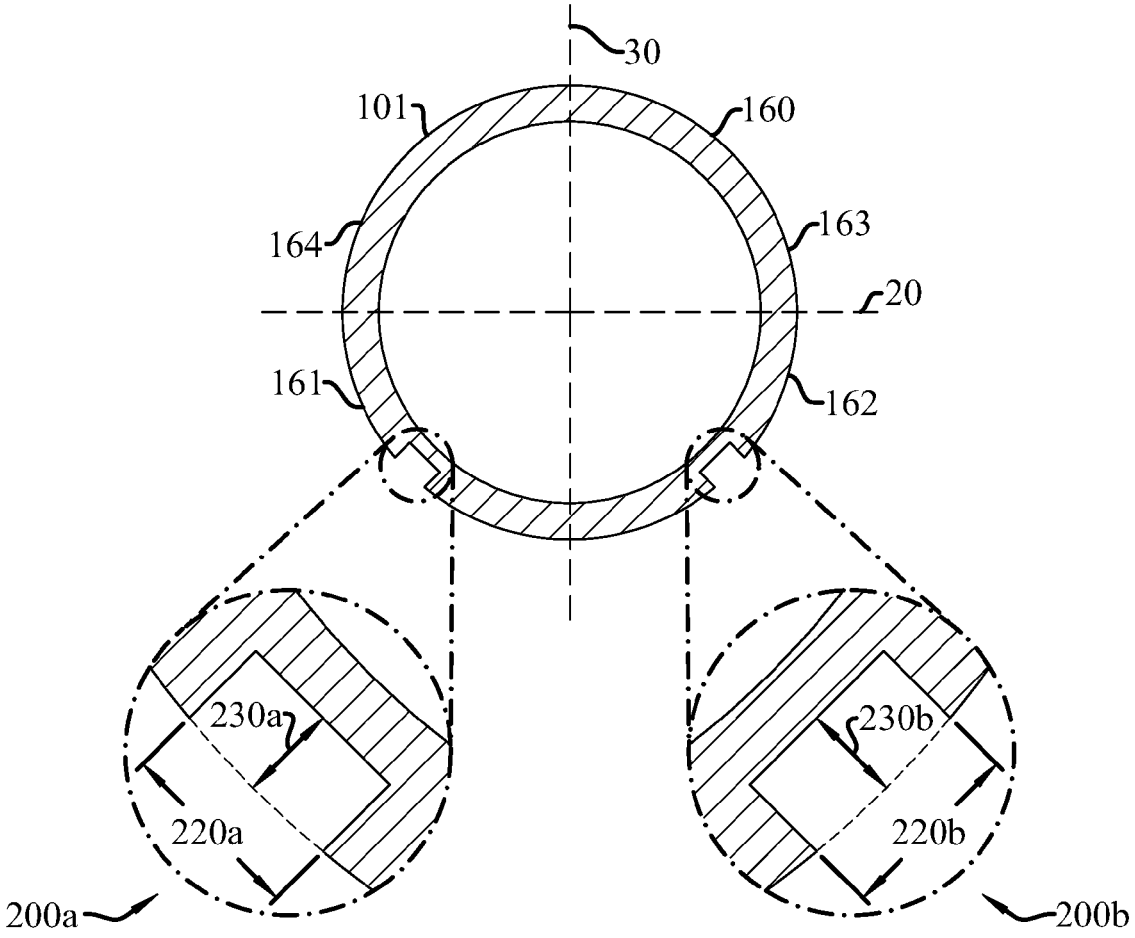
FIG. 22 is a cross-sectional view of the embodiment of the golf grip shown in FIG. 21 taken along section line 22-22, not to scale.

With reference now to FIGS. 21 and 22, still another embodiment of the golf grip (100) is shown. In this particular embodiment, the golf grip (100) further includes a second alignment channel (200*b*) extending longitudinally along the exterior body surface (160), as seen in FIG. 21. As seen in FIG. 22, the second alignment channel (200*b*) is confined to a second alignment quadrant selected from the group consisting of the first quadrant (161), the second quadrant (162), the third quadrant (163), and the fourth quadrant (164) that does not include the first alignment channel (200*a*). The second alignment channel (200*b*) has a second channel length (210*b*), a second channel width (220*b*), and a second channel depth (230*b*), as seen in FIGS. 21 and 22. In this embodiment, there is only the second alignment channel (200*b*) in the second alignment quadrant.

Although FIG. 22 shows the first alignment channel (200*a*) in the first quadrant (161) and second alignment channel (200*b*) in the second quadrant, the second alignment channel (200*b*) could also be located in the third quadrant (163) or the fourth quadrant (164), with respect to the positioning of the first alignment channel (200*a*) and how the quadrants (161, 162, 163, 164) are defined in FIG. 22. Generally, the second alignment channel (200*b*) should be spaced from the first alignment channel (200*a*) by at least a 10 degree angle, as measured from the point of intersection between the first vertical plane (20) and the second vertical plane (30), which point of intersection would typically be the geometric center of the proximal end (120), i.e., the butt end, of the golf grip (100) from a top plan view.

In one particular embodiment, the second alignment channel (200*b*) is circumferentially spaced from the first alignment channel (200*a*) by at least 6.35 millimeters. Such spacing ensures that first and second alignment channels (200*a*, 200*b*) are not so close together that a golfer would not be able to detect by tactile perception the two distinct channels (200*a*, 200*b*).

In one embodiment, the first channel width (220*a*) and the second channel width (200*b*) are each at least 2.0 millimeters, and the first channel depth (230*a*) and the second channel depth (230*b*) are each at least 0.5 millimeters. In another preferred embodiment the second channel depth (230*b*) is between twenty-five percent and fifty percent of the second channel width (220*b*). As previously discussed, such dimensions accommodate two-point discrimination, and thus allow a golfer to tactilely perceive the first alignment channel (200*a*) and the second alignment channel (200*b*), while still maintaining the structural integrity of the grip and its resistance to twisting. By providing a second alignment channel (200*b*), there is an increased opportunity for both of the golfer's hands, and associated fingers, to come into contact with an alignment channel (200*a*, 200*b*) in order to receive maximum psychomotor feedback. Moreover, the size and dimensions of the first and second alignment channels (200*a*, 200*b*) accommodate water run off when the grip (100) is used in rainy weather conditions and also facilitates sweat run off. The first and second alignment channels (200*a*, 200*b*) further assist the golfer in holding the grip (100) and provide the grip (100) with an anti-torsion effect that helps keep the grip (100) from rotating in a golfer's hands during use.

The golf grip (100) may be selectively applied to a golf club shaft (not shown) such that the first alignment channel (200*a*) and the second alignment channel (200*b*) coincide with a pre-selected, golfer preferred, hand and finger placement on the golf grip (100). As such, the first and second alignment channels (200*a*, 200*b*) additionally perform a "reminder" function. For example, when the golf grip (100) is selectively applied to a golf club shaft, the golfer will be able to feel the first and second alignment channels (200*a*, 200*b*) and know whether they are grasping the golf grip (100) with their preferred hand and finger placement on the golf grip (100). By knowing that the first and second alignment channels (200*a*, 200*b*) coincide with the preferred hand and finger placement and being able to tactilely perceive the first and second alignment channel (200*a*, 200*b*), the golfer will have a higher level of psychomotor confidence, which results in a better golf stroke. Moreover, the first and second alignment channels (200*a*, 200*b*) allow a golfer to determine both visually and by feel, whether the golf grip (100) has been applied to the golf club shaft in such a way that the proximal end (120) and the distal end (130) are aligned and the golf grip (100) is free of any rotational deformities.

Figure 23:
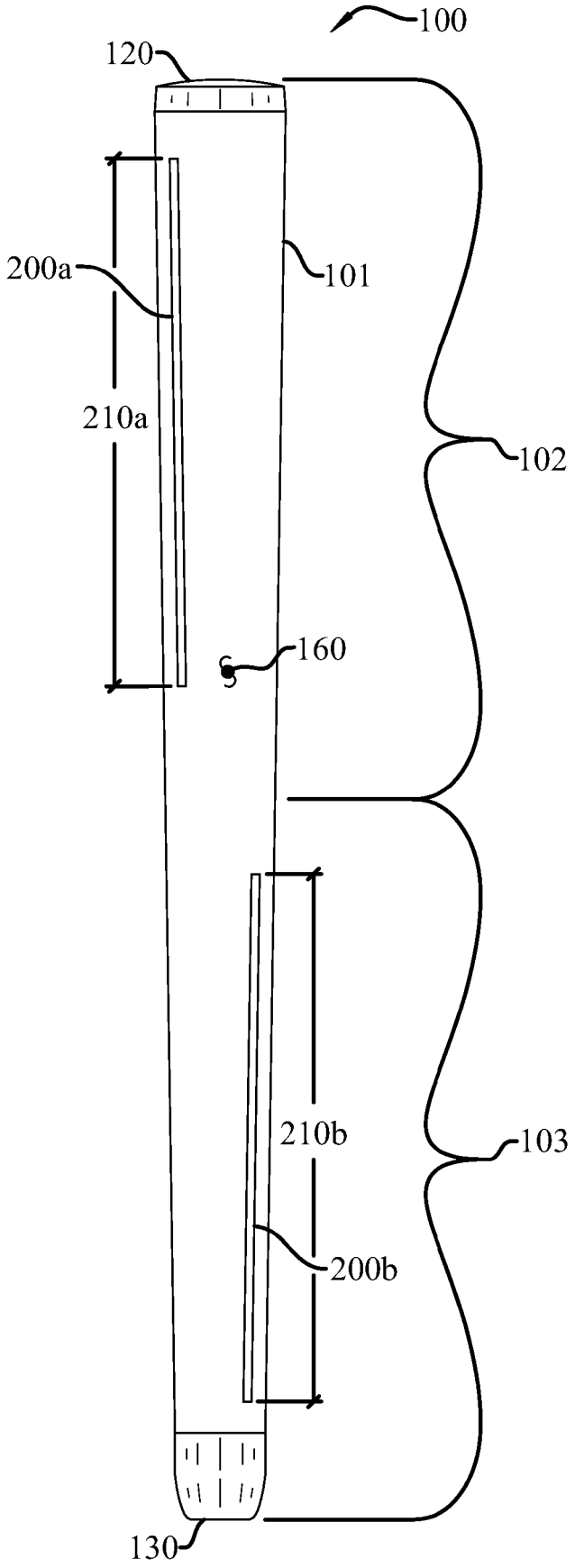
FIG. 23 is a front elevation view of an embodiment of a golf grip, not to scale.

Referring now to FIG. 23, an additional embodiment of the golf grip (100) having a first alignment channel (200*a*) and a second alignment channel (200*b*) is shown. In this particular embodiment, the first alignment channel (200*a*) is confined to the upper portion (102) of the golf grip (100) and the second alignment channel (200*b*) is confined to the lower portion (103) of the golf grip (100). Although not specifically shown in FIG. 23, it should be noted that the first alignment channel (200*a*) is confined to the first quadrant (161) and the second alignment channel (200*b*) is confined to the second quadrant (162). This particular embodiment strategically positions the first alignment channel (200*a*) and the second alignment channel (200*b*) so that the left thumb of a right-handed golfer using a conventional grip contacts the first alignment channel (200*a*) and the golfer's right thumb contacts the second alignment channel (200*b*). Thus, the golfer will be able to tactilely perceive the first and second alignment channels (200*a*, 200*b*) and know that they are grasping the golf grip (100) with their pre-selected, preferred hand and finger placement on the golf grip (100), which will lead to a higher level of psychomotor confidence, resulting in a better golf stroke. Of course, an embodiment suited for a left-handed golfer using a conventional grip is also contemplated. In the left-handed version of the golf grip (100), the first alignment channel (200*a*) would be confined to the lower portion (103) and the second alignment channel (200*b*) would be confined to the upper portion (102) such that that the left thumb of a left-handed golfer using a conventional grip contacts the first alignment channel (200*a*) and the golfer's right thumb contacts the second alignment channel (200*b*).

Figure 23A:
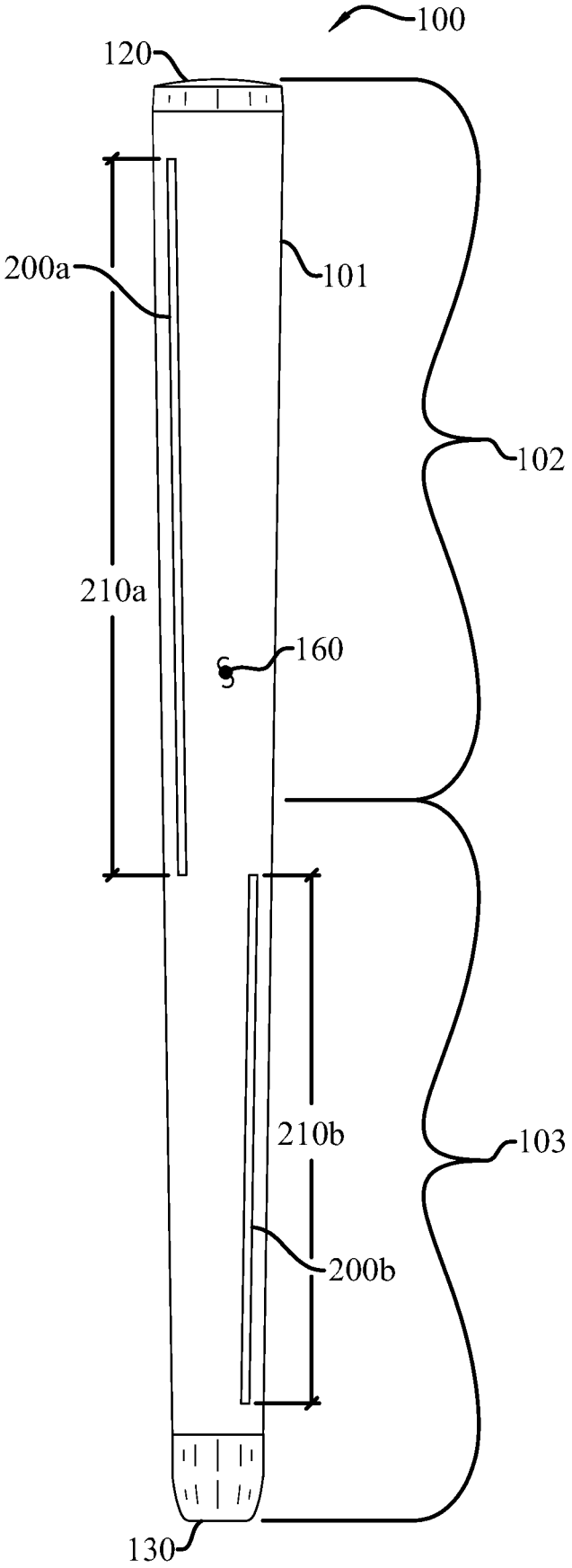
FIG. 23*a* is a front elevation view of an embodiment of a golf grip, not to scale.

In yet another embodiment, a portion of the first alignment channel (200*a*) is located in the upper portion (102) of the golf grip (100) and a portion of the first alignment channel (200*a*) is located in the lower portion (103) of the golf grip (100), while the second alignment channel (200*b*) is confined to the lower portion (103), as seen in FIG. 23*a*. This particular embodiment ensures that a golfer's thumbs will contact the first and second alignment channels (200*a*, 200*b*) when "choking down" on the golf grip (100), which commonly occurs when golfers execute chip shots, short pitch shots, knock-down shots, and punch shots. This embodiment of the golf grip (100) may also be designed for left-handed golfers wherein a portion of the second alignment channel (200*b*) would be located in both the upper and lower portion (102, 103) of the golf grip (100) and the first alignment channel (200*a*) would be confined to the lower portion (103).

Figure 24:
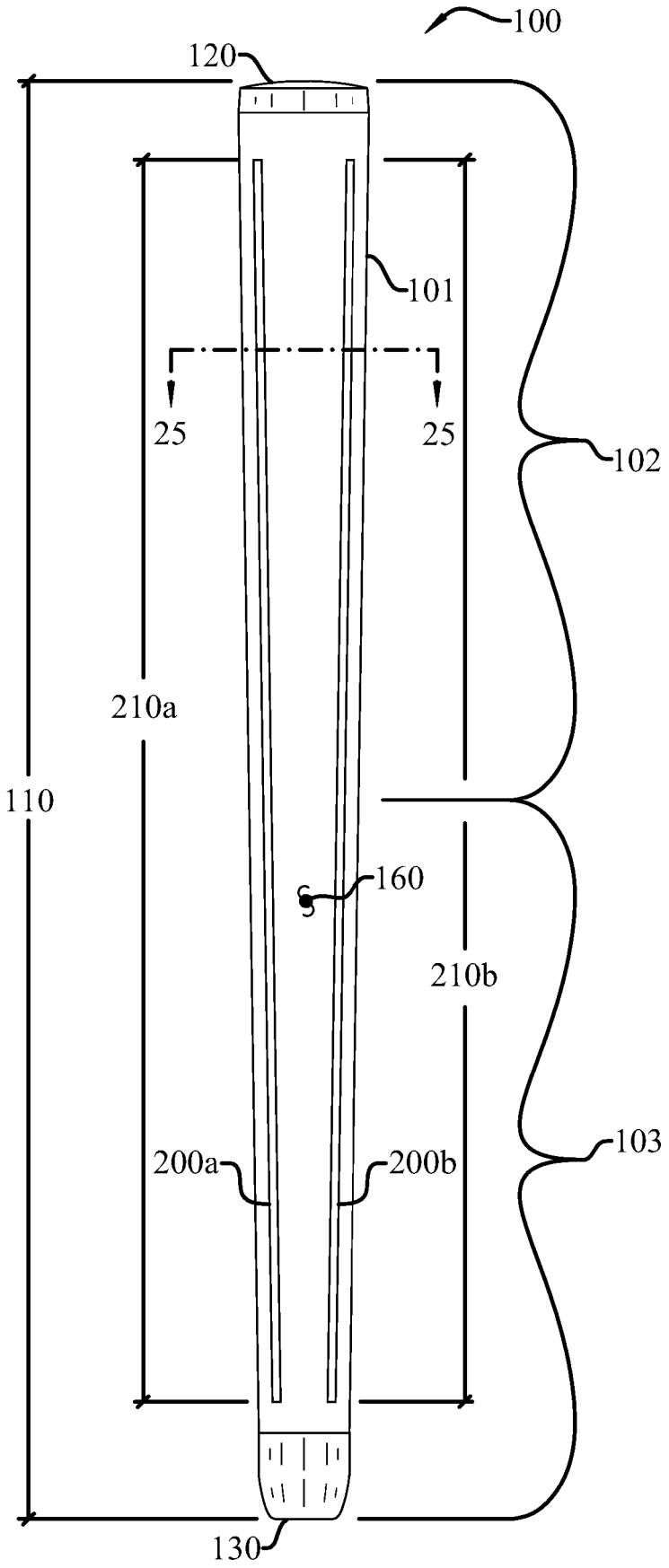
FIG. 24 is a front elevation view of an embodiment of a golf grip, not to scale.
Figure 25:
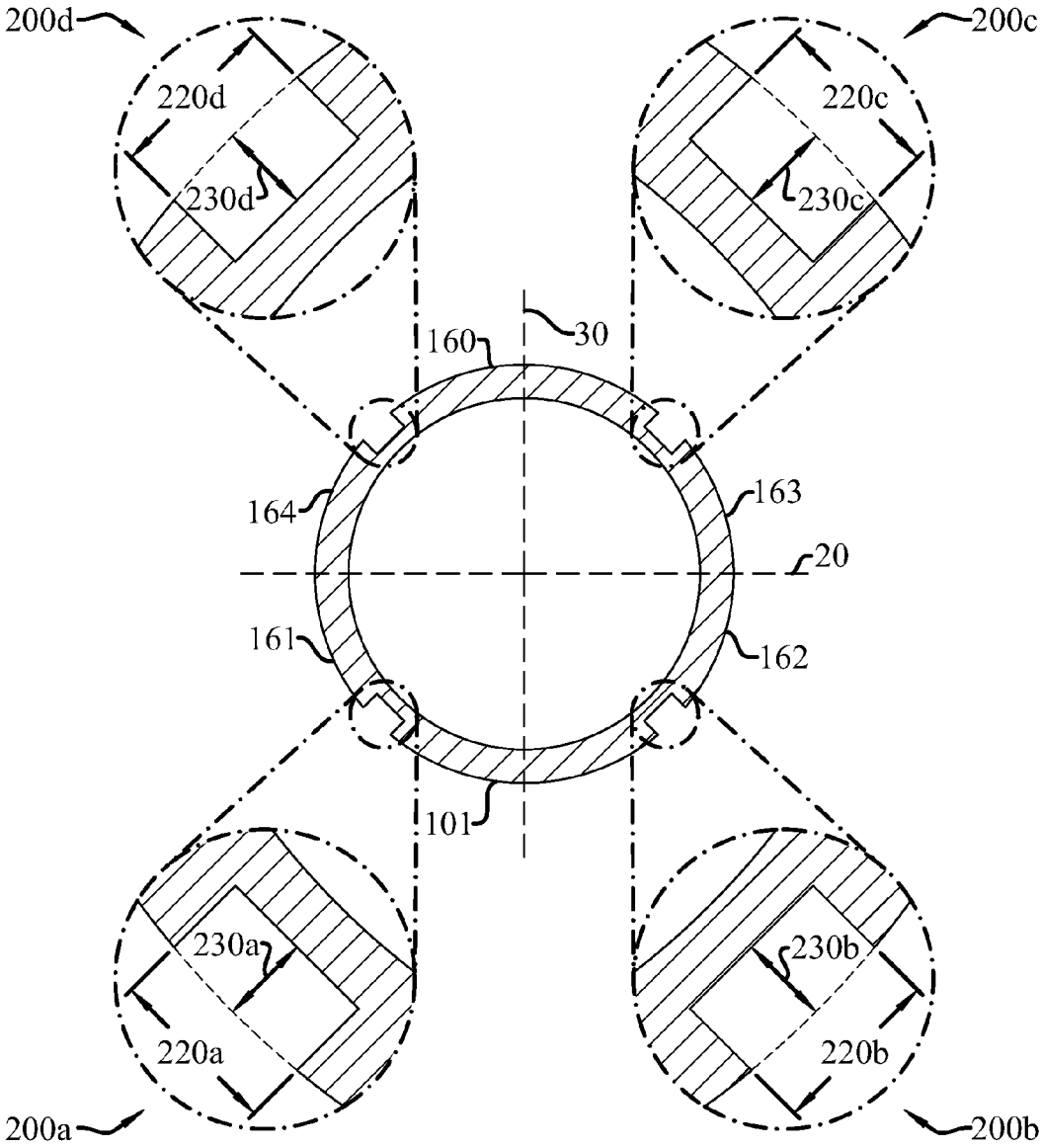
FIG. 25 is a cross-sectional view of the embodiment of the golf grip shown in FIG. 24 taken along section line 25-25, not to scale.
Figure 26:
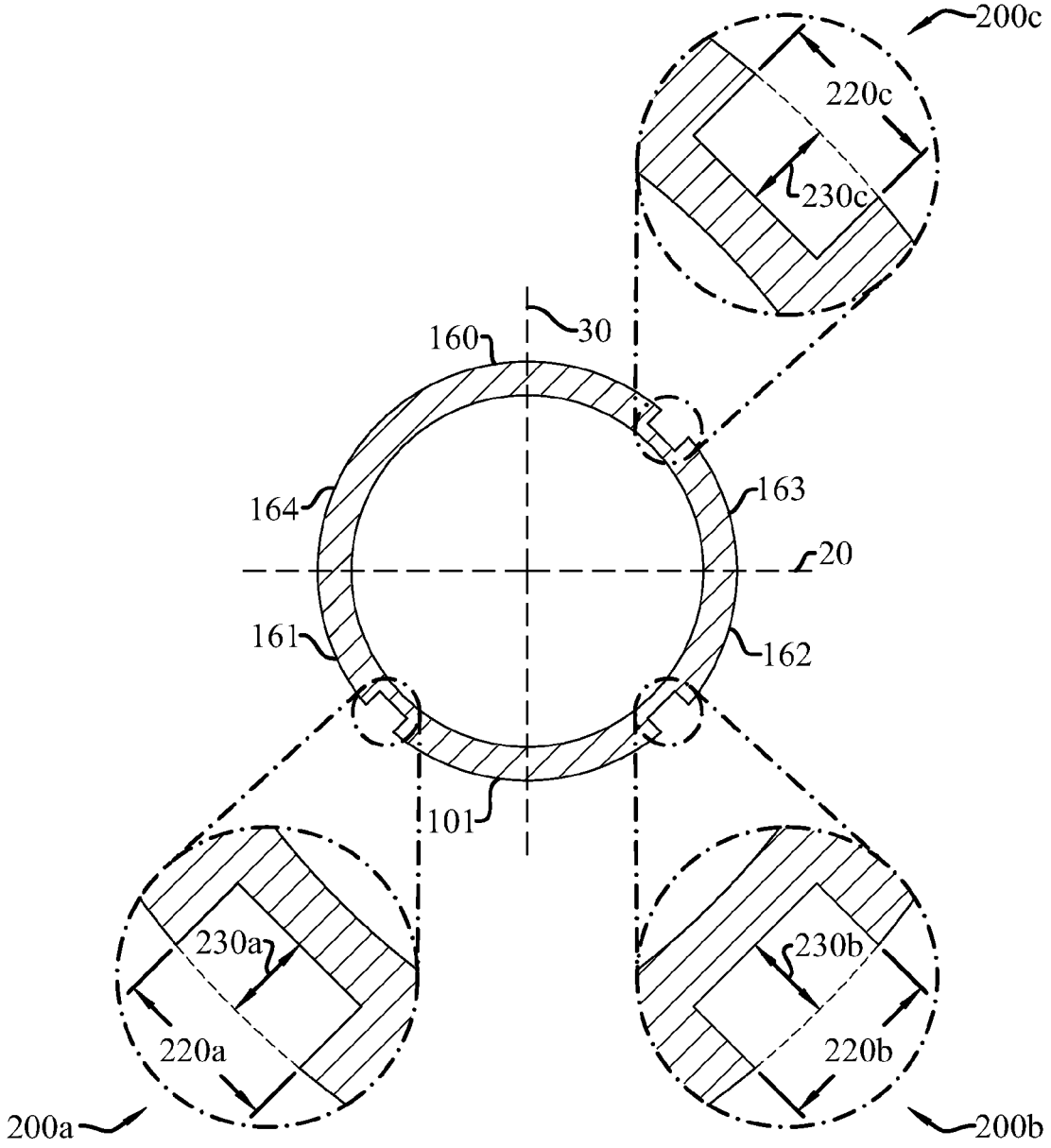
FIG. 26 is a cross-sectional view of an embodiment of a golf grip, not to scale.

With reference to FIGS. 24-26, additional embodiments of the golf grip (100) are shown. Referring first to FIG. 26, a cross-sectional view of an embodiment of the golf grip (100) is shown. In this particular embodiment, the golf grip (100) further includes a third alignment channel (200*c*) extending longitudinally along the exterior body surface (160) and confined to a third alignment quadrant selected from the group consisting of the first quadrant (161), the second quadrant (162), the third quadrant (163), and the fourth quadrant (164) that does not include the first alignment channel (200*a*) or the second alignment channel (200*b*). The third alignment channel (200*c*) has a third channel length (210*c*) (not shown), a third channel width (220*c*), and a third channel depth (230*c*), as seen in FIG. 26. In this particular embodiment, there is only the third alignment channel (200*c*) in the third alignment quadrant.

Although FIG. 26 shows the first alignment channel (200*a*) in the first quadrant (161), the second alignment channel (200*b*) in the second quadrant, and the third alignment channel (200*c*) in the third quadrant (163), the third alignment channel (200*c*) could also be located in the fourth quadrant (164), with respect to the positioning of the first and second alignment channels (200*a*, 200*b*) and how the quadrants (161, 162, 163, 164) are defined in FIG. 26. Generally, the third alignment channel (200*c*) should be spaced from the first and second alignment channels (200*a*, 200*b*) in the closest adjacent quadrant (161, 162, 163, 164) by at least a 90 degree angle, as measured from the point of intersection between the first vertical plane (20) and the second vertical plane (30), which point of intersection would typically be the geometric center of the proximal end (120), i.e., the butt end, of the golf grip (100) from a top plan view.

Referring now to FIGS. 24 and 25, another embodiment of the golf grip (100) includes a first alignment channel (200*a*) extending longitudinally along the exterior body surface (160) and confined to the first quadrant (161), a second alignment channel (200*b*) extending longitudinally along the exterior body surface (160) and confined to the second quadrant (162), a third alignment channel (200*c*) extending longitudinally along the exterior body surface (160) and confined to the third quadrant (163), and a fourth alignment channel (200*d*) extending longitudinally along the exterior body surface (160) and confined to the fourth quadrant (164). In this particular embodiment, there is only the first, second, third, and fourth alignment channels (200*a*, 200*b*, 200*c*, 200*d*) on the exterior body surface (160) of the golf grip (100). However, as described above, "only" does not mean that there cannot be any additional surface patterns, texture changes, or other similar features on the exterior body surface (160); rather, it means that the exterior body surface (160) does not contain any additional features having a depth of at least 0.4 millimeters or a width of at least 1.0 millimeters. Each alignment channel (200*a*, 200*b*, 200*c*, 200*d*) has a corresponding channel length (210*a*, 210*b*, 210*c*, 210*d*), channel width (220*a*, 220*b*, 220*c*, 220*d*), and channel depth (230*a*, 230*b*, 230*c*, 230*d*). Preferably, each alignment channel (200*a*, 200*b*, 200*c*, 200*d*) is spaced at a 90 degree angle from the alignment channel (200*a*, 200*b*, 200*c*, 200*d*) located in an adjacent quadrant (161, 162, 163, 164), as measured from the point of intersection between the first vertical plane (20) and the second vertical plane (30), which would typically be the geometric center of the proximal end (120), i.e., the butt end, of the golf grip (100) from a top plan view, as seen in FIG. 25.

As previously discussed, the channel widths (220*a*, 220*b*, 200*c*, 220*d*) are preferably at least 2.0 millimeters, and the channel depths (230*a*, 230*b*, 230*c*, 230*d*) are preferably at least 0.5 millimeters. Such dimensions accommodate two-point discrimination, and thus allow a golfer to tactilely perceive the alignment channels (200*a*, 200*b*, 200*c*, 200*d*). By providing a third alignment channel (200*c*) or a third and fourth alignment channel (200*c*, 200*d*), there is an increased opportunity for both of the golfer's hands, and associated fingers, to come into contact with an alignment channel (200*a*, 200*b*, 200*c*, 200*c*) in order to receive maximum psychomotor feedback. Moreover, the dimensions of the alignment channels (200*a*, 200*b*, 200*c*, 200*d*) facilitate water run off from the exterior body surface (160) when the golf grip (100) is used in rainy weather conditions and also facilitates sweat run off. The alignment channels (200*a*, 200*b*, 200*c*, 200*d*) further assist the golfer in holding the grip (100) and provide the grip (100) with an anti-torsion effect that helps keep the grip (100) from rotating in a golfer's hands during use.

The channel lengths (210*a*, 210*b*, 210*c*, 210*d*) may be at least 50 percent of the grip length (110). Having the alignment channels (200*a*, 200*b*, 200*c*, 200*d*) extend along at least 50 percent of the grip length (110) allows a golfer to determine both visually and by feel whether the golf grip (100) has been applied to the golf club shaft in such a way that the proximal end (120) and the distal end (130) are aligned and free of rotational deformity. This is particularly true for embodiments having four alignment channels (200*a*, 200*b*, 200*c*, 200*d*). Moreover, providing alignment channels (200*a*, 200*b*, 200*c*, 200*d*) that extend along at least 50 percent of the grip length (110) accommodates the numerous styles of hand positioning and gripping used to grasp a golf club, including, but not limited to, a conventional grip, a strong gripping style, as seen in FIG. 32, a weak gripping style, as seen in FIG. 33, a claw type grip, or a saw type grip. Such channel lengths (210*a*, 210*b*, 210*c*, 210*d*) maximize the opportunity for the golfer's hands and fingers to come into contact with the alignment channels (200*a*, 200*b*, 200*c*, 200*d*) in order to receive maximum psychomotor feedback.

As previously discussed, the golf grip (100) may be selectively applied to a golf club shaft (not shown) such that the alignment channels (200*a*, 200*b*, 200*c*, 200*d*) coincide with a pre-selected, golfer preferred, hand and finger placement on the golf grip (100). For example, when installing the golf grip (100), the golf grip (100) may be rotated until one or more alignment channels (200*a*, 200*b*, 200*c*, 200*d*) correspond to the particular golfer's preferred hand and finger placement on the golf grip (100). As such, the alignment channels (200*a*, 200*b*, 200*c*, 200*d*) additionally perform a "reminder" function. For example, when the golf grip (100) is selectively applied to a golf club shaft, the golfer will be able to feel the alignment channels (200*a*, 200*b*, 200*c*, 200*d*) and know whether they are grasping the golf grip (100) with their pre-selected, preferred hand and finger placement on the golf grip (100). By knowing that the alignment channels (200*a*, 200*b*, 200*c*, 200*d*) coincide with the preferred hand and finger placement and being able to tactilely perceive the alignment channels (200*a*, 200*b*, 200*c*, 200*d*), the golfer will have a higher level of psychomotor confidence, which results in a better golf stroke. Moreover, the alignment channels (200*a*, 200*b*, 200*c*, 200*d*) allow a golfer to determine both visually and by feel whether the golf grip (100) has been applied to the golf club shaft in such a way that the proximal end (120) and the distal end (130) are aligned and the golf grip (100) is free of rotational deformities.

Similar to the embodiment shown in FIG. 23, in one embodiment of the golf grip (100) having a first, second, third, and fourth alignment channel (200*a*, 200*b*, 200*c*, 200*d*), the first alignment channel (200*a*) and the third alignment channel (200*c*) are confined to the upper portion (102) of the golf grip (100), while the second alignment channel (200*b*) and the fourth alignment channel (200*d*) are confined to the lower portion (103) of the golf grip (100). In other words, the position of an alignment channel (200*a*, 200*b*, 200*c*, 200*d*) alternates between the upper portion (102) and the lower portion (103) for each adjacent quadrant (161, 162, 163, 164). This particular embodiment strategically positions the alignment channels (200*a*, 200*b*, 200*c*, 200*d*) so that the golfer's thumbs, regardless of whether the golfer is right or left-handed, may contact an alignment channel (200*a*, 200*b*, 200*c*, 200*d*). Thus, the golfer will be able to tactilely perceive the alignment channels (200*a*, 200*b*, 200*c*, 200*d*) and know that they are grasping the golf grip (100) with their pre-selected, preferred hand and finger placement on the golf grip (100), which will lead to a higher level of psychomotor confidence, resulting in a better golf stroke.

In a further embodiment, the golf grip (100) may have alignment channels (200*a*, 200*b*, 200*c*, 200*d*) that alternate between the upper portion (102) and the lower portion (103) for each adjacent quadrant (161, 162, 163, 164), as previously described, but the alignment channels (200*a*, 200*b*, 200*c*, 200*d*) positioned primarily in the upper portion (102) may also extend into the lower portion (103) of the golf grip (100). This particular embodiment ensures that a golfer's thumbs, regardless of whether the golfer is right or left-handed, will contact an alignment channel (200*a*, 200*b*, 200*c*, 200*d*) when "choking down" on the golf grip (100), which commonly occurs when golfers execute chip shots, short pitch shots, knock-down shots, and punch shots.

It is contemplated that the alignment channels (200*a*, 200*b*, 200*c*, 200*d*) may be custom placed on the exterior body surface (160) of the golf grip (100) according to the particular golfer's preference so long as there is only one alignment channel (200*a*, 200*b*, 200*c*, 200*d*) per quadrant (161, 162, 163, 164) as previously described. For embodiments of the golf grip (100) having only a first alignment channel (200*a*), the golf grip (100) may be rotated during installation of the grip on the golf club shaft (not shown) until the position of the first alignment channel (200*a*) suits the particular golfer's preference.

Figure 27:
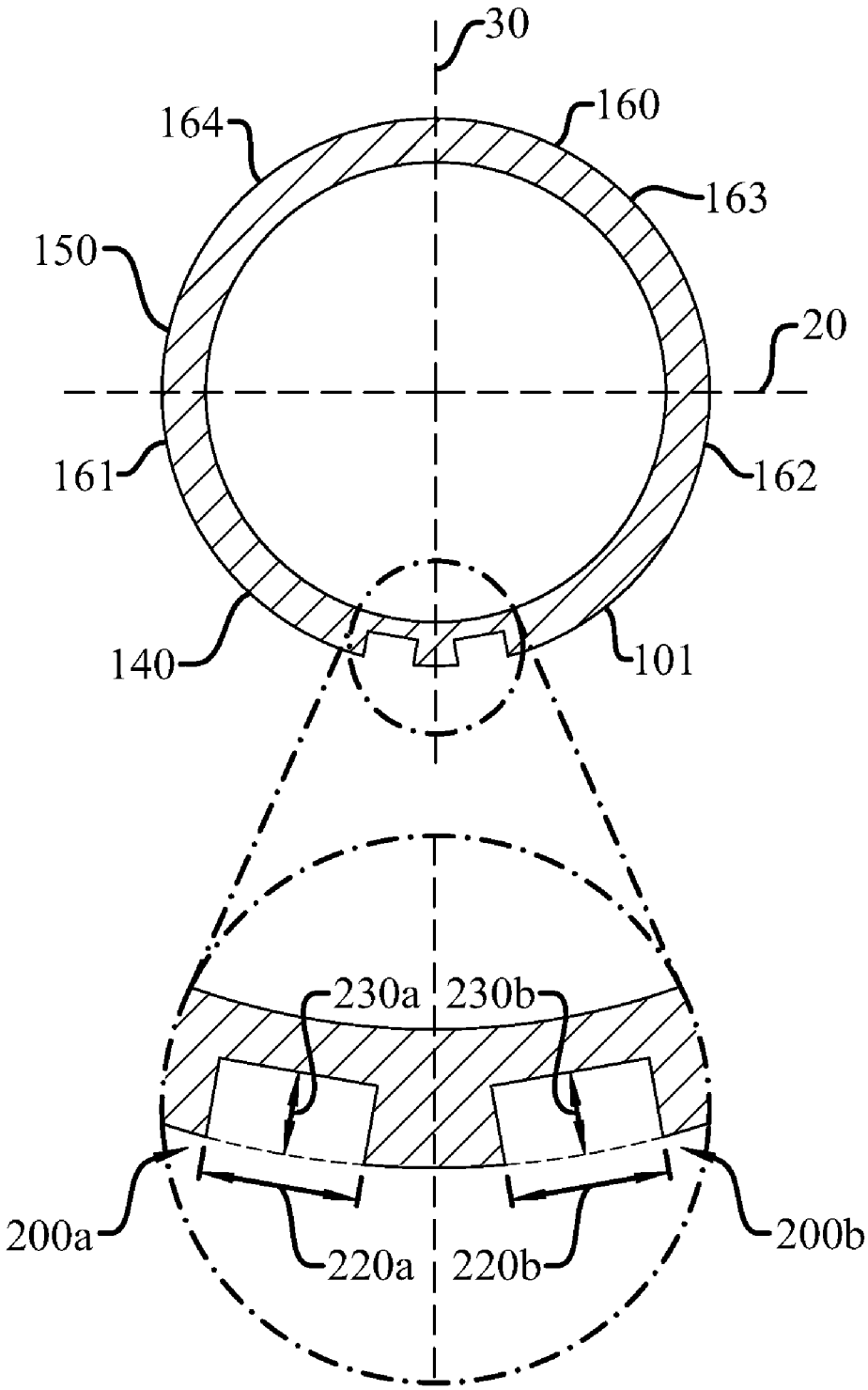
FIG. 27 is a cross-sectional view of an embodiment of a golf grip, not to scale.

To further illustrate the alignment channels (200*a*, 200*b*, 200*c*, 200*d*) on the golf grip (100), reference is now made to FIG. 27. It should be noted that in this particular embodiment, the golf grip (100) has been installed on a golf club shaft of a golf club. As such, the golf grip (100) may further be defined as having an anterior surface (140) and a posterior surface (150). As previously described, the anterior surface (140) refers to a half of the exterior surface (160) of the golf grip (100) that faces away from the golfer when the golf club is soled on a playing surface. The posterior surface (150) is directly opposite the anterior surface (140), and thus would face towards the golfer when the golf club is soled. As seen in FIG. 27, an imaginary first vertical plane (20) divides the golf grip (100) into equal halves, with one half representing the anterior surface (140) and one half representing the posterior surface (150). An imaginary second vertical plane (30) orthogonally intersects the imaginary first vertical plane (20) at the geometric center of the proximal end (120), i.e., the butt end, of the grip (100) from a top plan view. The geometric center may also be thought of in terms of a grip axis that extends from the proximal end (120) to the distal end (130). Moreover, when applied to a golf club shaft, the grip axis will typically coincide with a shaft axis of the golf club shaft. As seen in FIG. 27, the point of intersection between the imaginary first vertical plane (20) and the imaginary second vertical plane (30) coincides with the grip axis.

Still referring to FIG. 27, and as previously explained, the intersection of the first and second vertical planes (20, 30) further define the exterior body surface (160) into four equal quadrants (161, 162, 163, 164). Thus, in this embodiment, the anterior surface (140) is further divided into two equal first and second quadrants (161, 162), while the posterior surface (150) is further divided into two equal third and fourth quadrants (163, 164). As seen in FIG. 27, this particular embodiment includes a first alignment channel (200*a*) positioned in the first quadrant (161) and a second alignment channel (200*b*) positioned in the second quadrant (162). Preferably, the first and second alignment channels (200*a*, 200*b*) are positioned and spaced from one another at an angle of at least 10 degrees as measured from the point of intersection between the imaginary first vertical plane (20) and the imaginary second vertical plane (30). Of course, other embodiments are contemplated in which each quadrant (161, 162, 163, 164) includes only one alignment channel (200*a*, 200*b*, 200*c*, 200*d*), wherein each alignment channel (200*a*, 200*b*, 200*c*, 200*d*) is positioned and spaced from one another at an angle of at least 10 degrees as measured from the point of intersection between the imaginary first vertical plane (20) and the imaginary second vertical plane (30).

Figure 29:
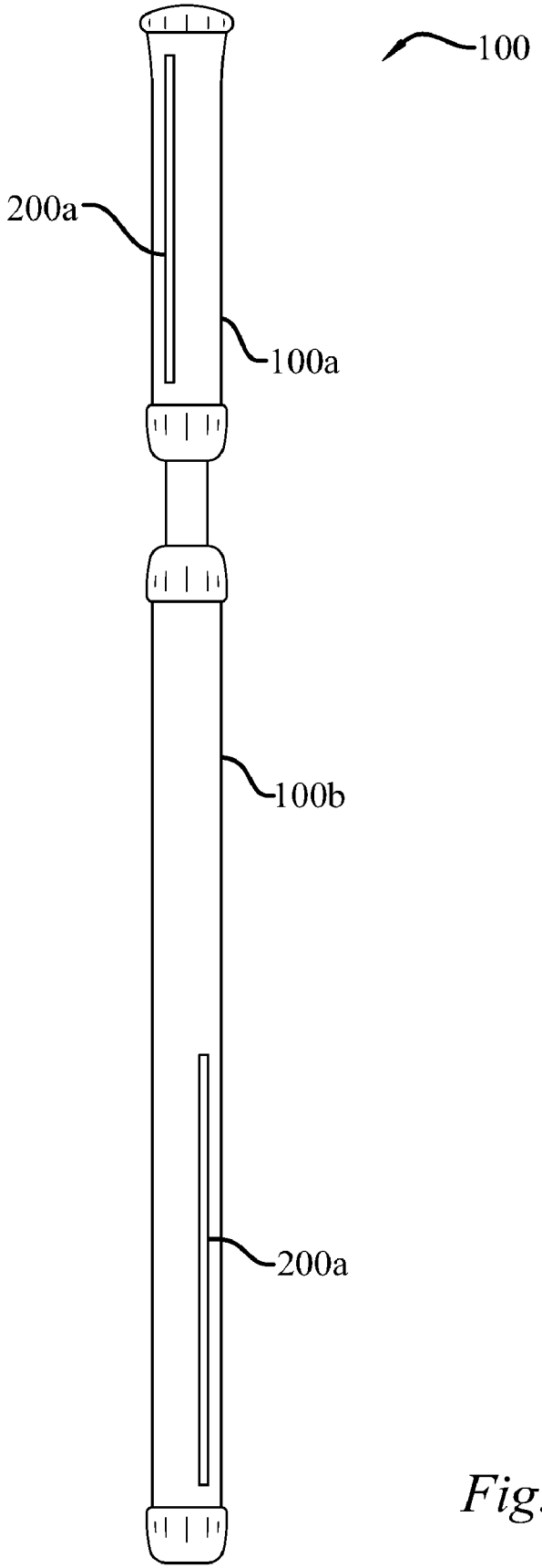
FIG. 29 is a front elevation view of an embodiment of a golf grip, not to scale.

In still a further embodiment, the golf grip (100) may be utilized on a long putter or a belly putter. As seen in FIG. 29, in this particular embodiment, the grip body (101) is divided into a top section (100*a*) and a bottom section (100*b*), with each section (100*a*, 100*b*) installed on the golf shaft and separated by a grip separation distance. The previous disclosure regarding the grip body (101) applies equally well to both the top section (100*a*) and the bottom section (100*b*), and thus will not be repeated. When installing the top section (100*a*) and the bottom section (100*b*) on a golf club shaft of a long putter or a belly putter, any alignment channels (200*a*, 200*b*, 200*c*, 200*d*) on the top section (100*a*) may be aligned with any alignment channels (200*a*, 200*b*, 200*c*, 200*d*) on the bottom section (100*b*). Moreover, the top section (100*a*) and the bottom section (100*b*) may be installed such that the alignment channels (200*a*, 200*b*, 200*c*, 200*d*) on each section (100*a*, 100*b*) are offset and do not align. Further, the golfer may choose to install the top and bottom sections (100*a*, 100*b*) with any particular configuration of alignment channels (200*a*, 200*b*, 200*c*, 200*d*) that is best suited for their preferred style of hand and finger placement on the top and bottom sections (100*a*, 100*b*).

Figure 30:
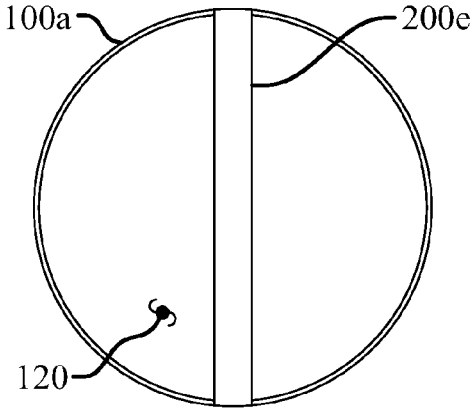
FIG. 30 is a top plan view of an embodiment of a golf grip, not to scale.
Figure 30A:
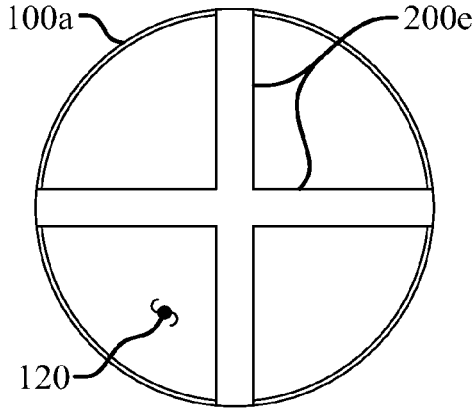
FIG. 30*a* is a top plan view of an embodiment of a golf grip, not to scale.
Figure 31:
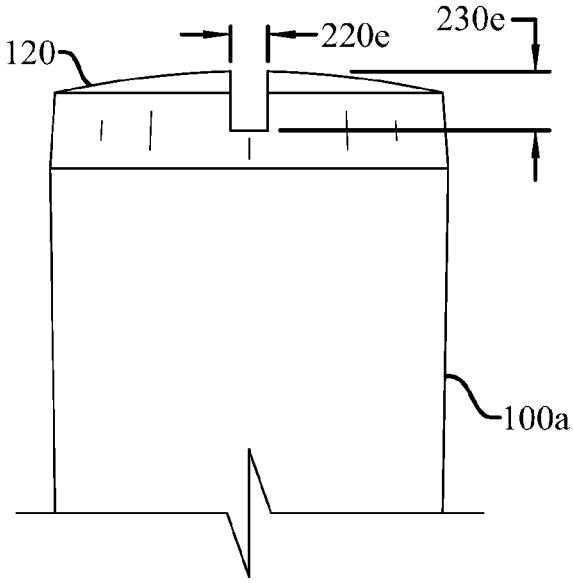
FIG. 31 is an elevation view of a portion of an embodiment of a golf grip, not to scale.

In still another embodiment, the top section (100*a*) may include at least one butt end alignment channel (200*e*), as seen in FIGS. 30, 30*a* and 31. The butt end alignment channel (200*e*) has butt end alignment channel width (220*e*) of at least 2.0 millimeters and a butt end alignment channel depth (230*e*) of at least 0.5 millimeters. The butt end alignment channel (200*e*) preferably extends along the geometric center of the proximal end (120), i.e., butt end, of the top section (100*a*). Moreover, the butt end alignment channel (200*e*) may be positioned such that it is parallel to the intended shot direction or perpendicular to the intended shot direction. Such an embodiment provides users of long putters another area for receiving feedback by tactile perception, as many users of long putters place their thumb on top of the proximal end (120), i.e., butt end, of the top section (100*a*) of the golf grip (100). Furthermore, the top section (100*a*) may include two butt end alignment channels (200*e*) that are perpendicular to one another and intersect at the geometric center of the proximal end (120), i.e., butt end, of the top section (100*a*), as seen in FIG. 30*a*. In this embodiment, the butt end alignment channels (200*e*) would simulate crosshairs with one butt end channel (200*e*) aligned parallel to the golf club face and the other butt end channel (200*e*) aligned parallel to the intended shot direction. Such an embodiment allows the golfer to get a better feel of whether their alignment is proper. It should also be noted that, in the alternative, the top section (100*a*) may include one or more butt end alignment projections (not shown) for providing the golfer with tactile feedback. The butt end alignment projections would have the same dimensions as the previously discussed alignment projection (300).

A method for creating a customized golf grip (100) for a golfer is also envisioned. In one embodiment, the method may comprise the steps of: determining a two-point discrimination threshold distance of a fingerpad of a finger of the golfer; selecting a golf grip (100) to be customized; and creating at least one channel (200) on the golf grip (100).

The two-point discrimination threshold distance may be determined by performing a two-point discrimination test on a fingerpad of a golfer's finger. Preferably, the fingerpad of the golfer's index finger is tested. Two-point discrimination is used to determine the level of sensibility of the tested fingerpad to interpret touch at the smallest, most precise level. The two-point discrimination test is typically performed with a caliper having pointed ends. The test is performed with the golfer's eyes closed. The person performing the test places one point or two points of various widths on a fingerpad of a golfer. The touching with one point or two points is random. The distance between the two points is gradually narrowed until the two-point discrimination threshold distance is reached. The two-point discrimination threshold distance may be defined as the minimum distance at which the golfer can differentiate between one point and two points. Two-point discrimination testing has been performed on several PGA tour professionals, and the test results indicate that these PGA tour professionals have two-point discrimination threshold distances of 1.0 millimeter or less. Thus, these PGA tour professionals are capable of sensing by tactile perception two distinct points that are separated by 1.0 millimeter or less.

Before or after determining the two-point discrimination threshold distance, the golfer may select a golf grip (100) to be customized. The golf grip (100) may be any golf grip (100) that the golfer desires to have customized. The golf grip (100) may be a putter grip or any type or kind of conventional round grip that is used in connection with iron and wood type golf clubs.

After selecting the golf grip (100) and determining the two-point discrimination threshold distance, the golf grip (100) may be customized by creating at least one channel (200) on the golf grip (100). The at least one channel (200) has a channel length (210), a channel width (220) that is greater than or equal to the two-point discrimination threshold distance, and a channel depth (230) that is at least twenty-five percent of the two-point discrimination threshold distance. The channel (200) dimensions ensure that the golfer will be able to sense the at least one channel (200) by tactile perception. Moreover, in one embodiment, the channel length (210) is at least twice the length of a distal phalanx of a thumb of the golfer. Such a channel length (210) ensures that when the at least one channel (200) is positioned on the golf grip (100) in an area where the golfer places one of their thumbs, a portion of the golfer's thumb will be in contact with the at least one channel (200). While in this embodiment the channel length (210) is merely an attribute of the channel (200), further embodiments may include the actual step of measuring the length of a distal phalanx of the thumb and customizing the channel length (210) accordingly. The at least one channel (200) may be created by any type of precision cutting process, such as a CNC machining process, laser cutting, or a water jet cutting process, just to name a few.

In another embodiment, the method may further include the steps of: (a) having the golfer grasp a golf grip (100) with the golfer's preferred hand and finger placement, and (b) recording the positioning of the golfer's preferred hand and finger placement on the golf grip (100). By recording the exact position of the golfer's preferred hand and finger placement on the golf grip (100), the at least one channel (200) may be custom placed to coincide with where the golfer prefers to place their thumbs or fingers on the golf grip (100). The recording step may be performed by marking a golf grip (100) with a marker color or paint, or even by wrapping a golf grip (100) with a pressure-sensitive recording tape that changes color in the exact location where pressure is applied. Thus, the at least one alignment channel (200) may be custom placed on a golf grip (100) for a golfer who prefers to use a strong gripping style, as seen in FIG. 32, or a golfer who prefers to use a weak gripping style, as seen in FIG. 33. After the recording step is completed, the at least one channel (200) may be created as previously described.

In one particular embodiment the method of customization includes the step of determining a non-dominant thumb preferred location of a non-dominant thumb when the golfer holds the golf grip (100) and locating the channel (200) to coincide with the non-dominant thumb preferred location. For a right handed golfer the non-dominant thumb is the thumb of the left hand, while for a left handed golf the non-dominant thumb is the thumb of the right hand.

In an even further embodiment the same step may be utilized regarding a preferred location of the dominant thumb. Obviously, the dominant thumb of a right handed golfer is the thumb of the right hand, while for a left handed golf the dominant thumb is the thumb of the left hand. This embodiment includes a step of determining a dominant thumb preferred location of a dominant thumb when the golfer holds the golf grip (100) and creating a second alignment channel (200*b*) on the golf grip (100) to coincide with the dominant thumb preferred location. In yet a further embodiment the second alignment channel (200*b*) is circumferentially spaced from the channel (200) corresponding to the non-dominant thumb preferred location by at least three times the two-point discrimination threshold distance, thereby allowing for a very tactile distinction between the two channels without the need to even visually inspect the golf grip (100). The preferred locations discussed herein may mean the preferred location longitudinally between the proximal end (120) and the distal end (130) of the grip (100), the location radially on the exterior body surface (160), or both.

The visual and tactile confirmation golf grip (100) may be produced from a variety of materials. By way of example only, and not limitation, the golf grip (100) may be constructed of any conventional grip material, such as natural rubber, synthetic rubber, polymers, elastomers, leathers, and combinations thereof. The golf grip (100), or a portion thereof, may also be constructed from a metal material such as aluminum or Nitinol. For example, the alignment channel (200) may comprise aluminum while the remainder of the golf grip (100) comprises an elastomer material.

The golf grip (100) may be manufactured utilizing traditional grip manufacturing processes. For example, the golf grip (100) may be produced by injection molding or extrusion molding. However, conventional grip molding techniques are limited in their ability to produce a golf grip (100) having an alignment channel (200) or alignment projection (300) with distinct sharp edges, i.e., zero radius edges. Therefore, the golf grip (100) may be formed by a molding process followed by a CNC machining process. Additionally, the golf grip (100) may be produced by an advanced compression molding process, laser cutting, or a water jet. The golf grip (100) may be included as a part of an original equipment manufacturer's golf club. Additionally, the golf grip (100) may be available for purchase separately or as a part of a regripping kit.

Referring now to FIGS. 9-13, a system to confirm proper orientation of a golf grip (100) with respect to a golf club face (10) is illustrated. The system generally includes a golf grip (100) and an alignment device (400). Preferably, the golf grip (100) of the system is constructed according to one of the embodiments of the visual and tactile confirmation golf grip (100) as described above. However, the golf grip (100) may be any conventional grip.

As seen in FIGS. 9-12, in one particular embodiment of the system, the alignment device (400) is releasably secured to a visual and tactile confirmation golf grip (100) having an alignment channel (200). The alignment device (400) may be releasably secured to the golf grip (100) near a proximal end (120), as shown, near a distal end (130), or at any position on the golf grip (100). By way of example, and not limitation, the alignment device (400) may include hook and loop type fasteners, resilient clips, adjustable straps, or other types of fasteners to releasably secure the alignment device (400) to the golf grip (100).

Figure 9:
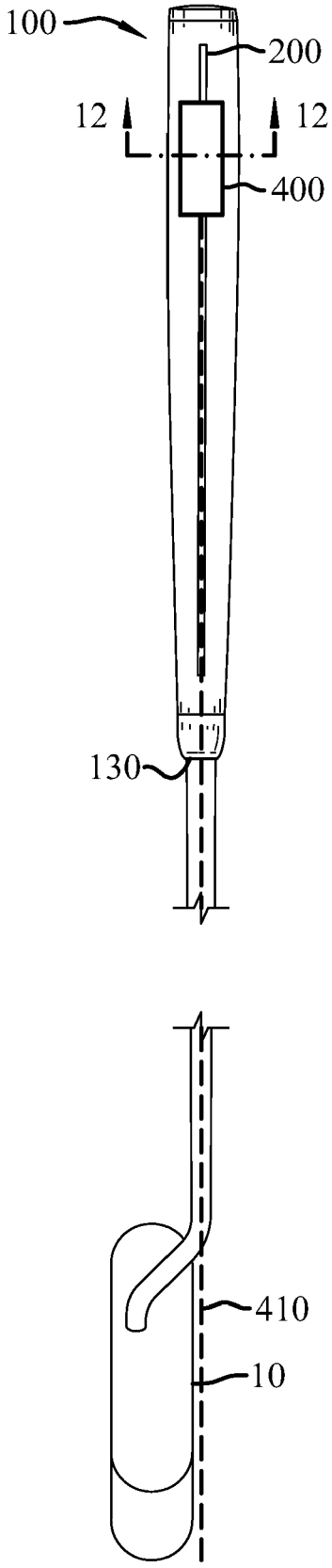
FIG. 9 is a front elevation view of an embodiment of a system to confirm proper orientation of a golf grip with respect to a golf club face, not to scale.
Figure 11:
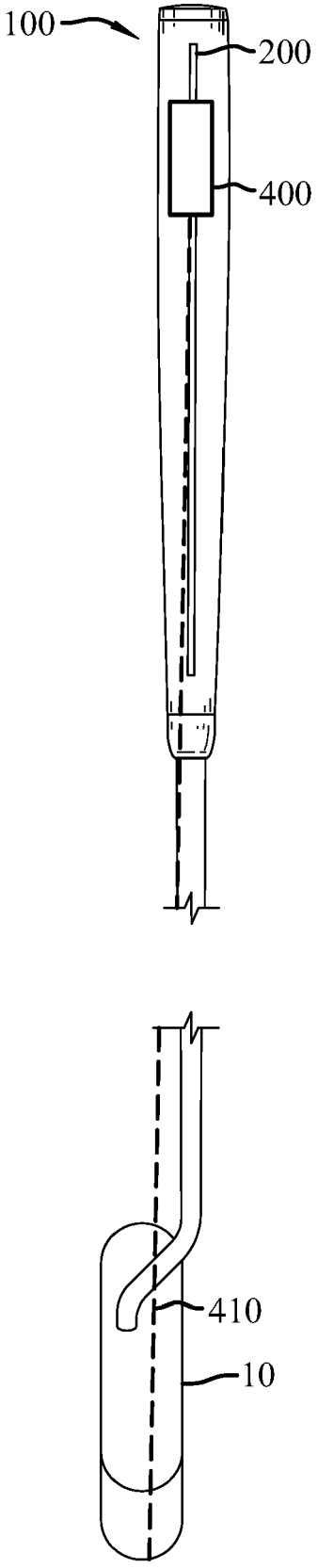
FIG. 11 is a front elevation view of an embodiment of a system to confirm proper orientation of a golf grip with respect to a golf club face, not to scale.

Referring now to FIG. 9, the alignment device (400) includes a feedback element (410) that projects along a straight line. With the alignment device (400) releasably secured and positioned on the golf grip (100), the golf grip (100) is adjusted such that the feedback element (410) and the alignment channel (200) are coincident to confirm that the golf grip (100) is free from rotational deformities. Failing to confirm that the feedback element (410) and the alignment channel (200) are coincident could result in the application of a twisted golf grip (100), as illustrated in FIG. 11.

In one particular embodiment, the feedback element (410) is a beam of laser light. The laser beam provides visual evidence that the golf grip (100) is aligned to the golf club face (10) in the desired orientation, or whether the golf grip (100) needs to be manipulated and adjusted to reach the desired orientation.

Figure 13:
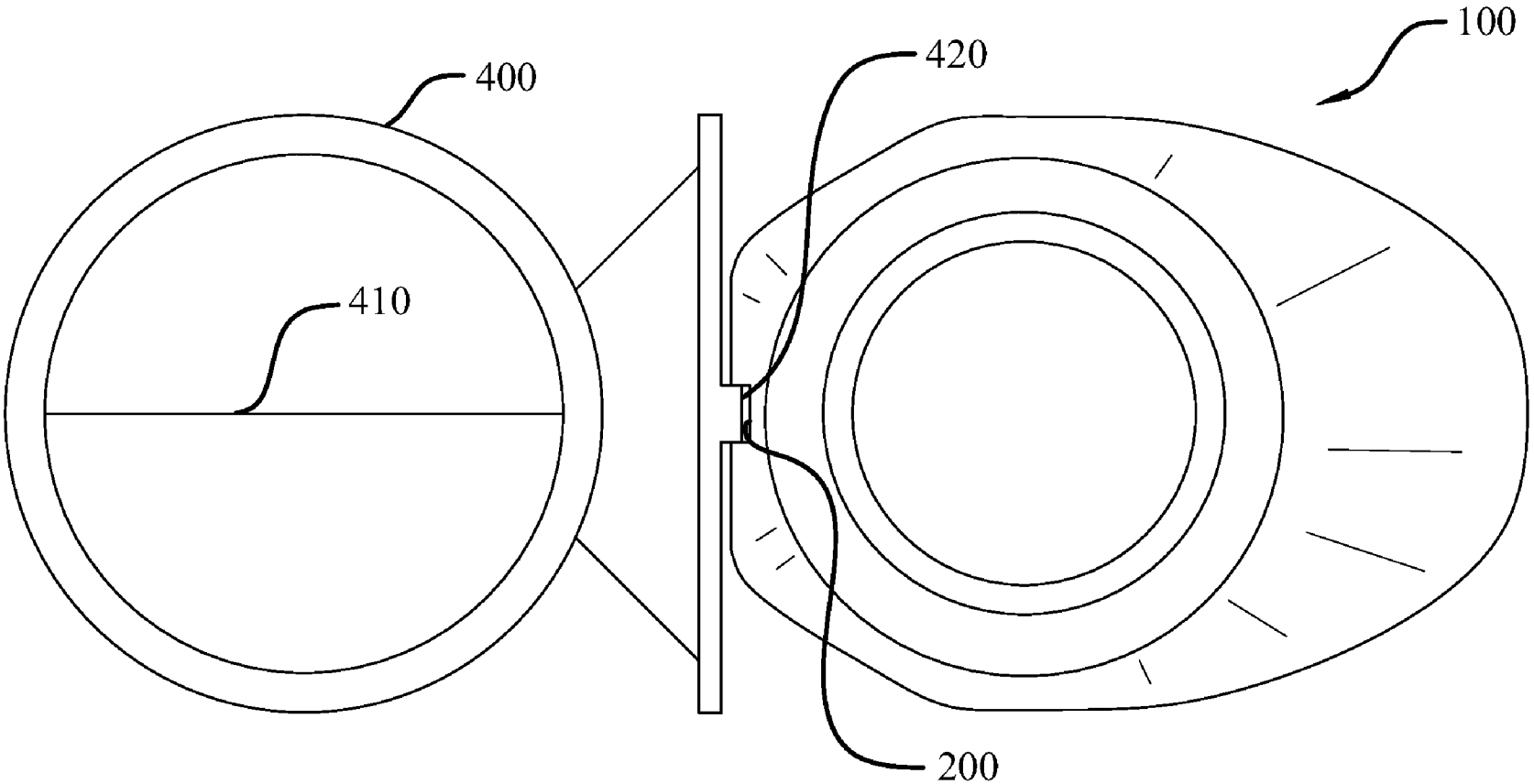
FIG. 13 is a top plan view of an embodiment of a system to confirm proper orientation of a golf grip with respect to a golf club face, not to scale.

In another embodiment, the feedback element (410) may be a reticle, as seen in FIG. 13. The reticle may be similar to a rifle scope, but would include only the vertical line of the crosshair. The reticle precisely indicates that the golf grip (100) is aligned in the desired orientation with respect to the golf club face (10), or whether the golf grip (100) requires adjustment to reach the desired orientation.

Figure 12:
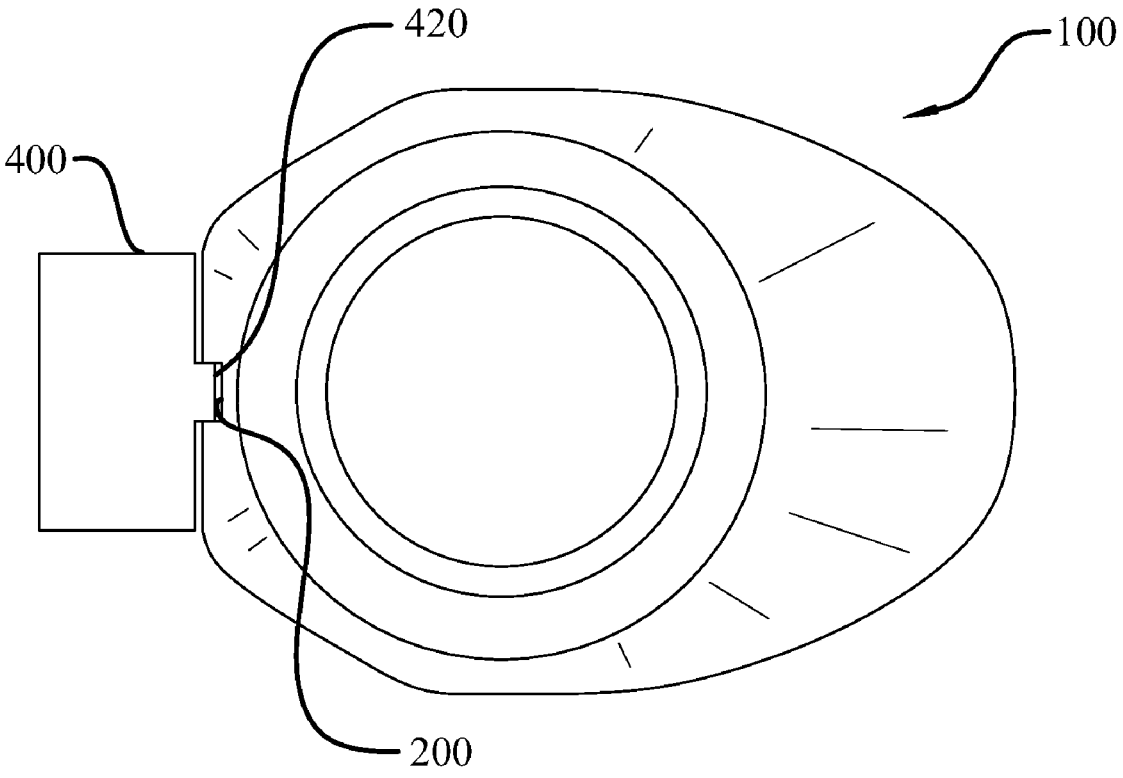
FIG. 12 is a cross-sectional view of the system taken along section line 12-12 of FIG. 9, not to scale.

In yet another embodiment, the alignment device (400) may include a positioning key (420) for cooperative engagement with the alignment channel (200), as best seen in FIG. 12. The positioning key (420) is configured to releasably secure the alignment device (400) by an interference fit in a predetermined position on the golf grip (100). Typically, the predetermined position will be along the longitudinal center of the anterior surface (140) for a more precise alignment. Likewise, for an embodiment utilizing a visual and tactile confirmation golf grip (100) having an alignment projection (300), the alignment device (400) may include a positioning keyway for cooperative engagement by an interference fit with the alignment projection (300).

After the alignment device (400) is releasably secured and positioned on the golf grip (100) and the feedback element (410) and the alignment channel (200) are aligned to be coincident with one another, the golf grip (100) may be adjusted until the feedback element (410) and the alignment channel (200) reach a desired position with respect to the golf club face (10). As seen in FIG. 9, the golf grip (100) has been adjusted such that the feedback element (410) and the alignment channel (200) are coincident and aligned parallel, or square, to the golf club face (10).

Figure 10:
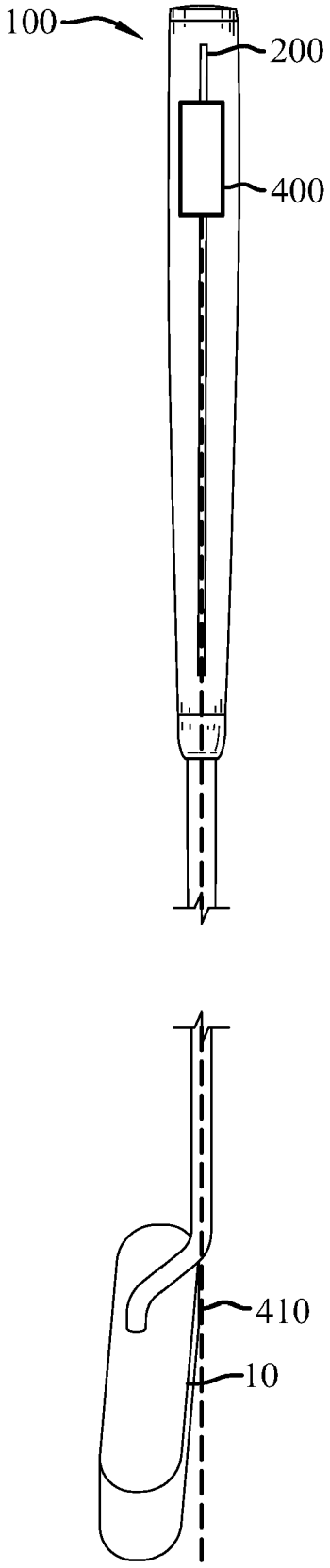
FIG. 10 is a front elevation view of an embodiment of a system to confirm proper orientation of a golf grip with respect to a golf club face, not to scale.

However, it should be noted that some golfers may prefer to have the golf club face (10) slightly diverge from the parallel alignment. For example, some golfers may have a tendency to close the golf club face (10) when making a stroke. These golfers would want a golf grip (100) installed such that the golf club face (10) is slightly open with respect to the feedback element (410) and the alignment channel (200), as seen in FIG. 10. The same principle would apply for those golfers who have a tendency to open the golf club face (10) when making a stroke. These golfers may prefer a golf grip (100) installed such that the golf club face (10) is slightly closed with respect to the feedback element (410) and the alignment channel (200).

Numerous alterations, modifications, and variations of the preferred embodiments disclosed herein will be apparent to those skilled in the art and they are all anticipated and contemplated to be within the spirit and scope of the golf grip (100) and system. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the golf grip (100) and system are described herein, it is to be understood that the practice of such additional modifications and variations and the equivalents thereof, are within the spirit and scope of the golf grip (100) and system as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A golf grip (100) comprising:

a grip body (101) having a grip length (110), a proximal end (120), a distal end (130), and an exterior body surface (160); and the exterior body surface (160) is defined by a first quadrant (161), a second quadrant (162), a third quadrant (163), and a fourth quadrant (164), and the golf grip (100) further includes:

a first alignment channel (200*a*) extending longitudinally along the exterior body surface (160) and confined to a first alignment quadrant, wherein the first alignment quadrant is selected from the group consisting of the first quadrant (161), the second quadrant (162), the third quadrant (163), and the fourth quadrant (164), the first alignment channel (200*a*) having a first channel length (210*a*), a first channel width (220*a*) of at least 2.0 millimeters, and a first channel depth (230*a*) of at least 0.5 millimeters; and a butt end alignment channel (200*e*) extending along the proximal end (120), wherein the butt end alignment channel (200*e*) has a butt end alignment channel width (220*e*) of at least 2.0 millimeters and a butt end alignment channel depth (230*e*) of at least 0.5 millimeters.

2. The golf grip (100) according to claim 1, wherein the butt end alignment channel (200*e*) extends continuously along the proximal end (120) from a first perimeter edge of the proximal end (120) to a second perimeter edge of the proximal end (120).

3. The golf grip (100) according to claim 1, further including a second butt end alignment channel extending along the proximal end (120), wherein the second butt end alignment channel has a second butt end alignment channel width of at least 2.0 millimeters and less than 5.0 millimeters and a second butt end alignment channel depth of at least 0.5 millimeters, and wherein the butt end alignment channel (200*e*) is perpendicular to the second butt end alignment channel.

4. The golf grip (100) according to claim 1, wherein the butt end alignment channel (200*e*) and a second butt end alignment channel intersect at a geometric center of the proximal end (120).

5. The golf grip (100) according to claim 1, wherein the butt end alignment channel (200*e*) and the first alignment channel (200*a*) each extend along a common vertical plane.

6. The golf grip (100) according to claim 1, wherein the butt end alignment channel (200*e*) extends along a first vertical plane and the first alignment channel (200*a*) extends along a second vertical plane, and the first vertical plane is perpendicular to the second vertical plane.

7. The golf grip (100) according to claim 1, wherein the grip body (101) has a substantially circular cross-section throughout the grip length (110).

8. The golf grip (100) according to claim 1, wherein the grip body (101) has a non-circular cross-section greater than 50 percent of the grip length (110).

9. The golf grip (100) according to claim 1, wherein the butt end alignment channel (200*e*) extends along a geometric center of the proximal end (120).

* * * * *